US012522337B1

(12) United States Patent
VanRuiswyk et al.

(10) Patent No.: US 12,522,337 B1
(45) Date of Patent: Jan. 13, 2026

(54) PROPULSOR ASSEMBLIES HAVING WEAR RESISTANT SNUBBER

(71) Applicant: Brunswick Corporation, Mettawa, IL (US)

(72) Inventors: Brad J. VanRuiswyk, Waupun, WI (US); Jay P. Dehling, Oshkosh, WI (US); Steven D. Draves, Fond du Lac, WI (US); Gregg D. Langenfeld, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 443 days.

(21) Appl. No.: 18/209,229

(22) Filed: Jun. 13, 2023

(51) Int. Cl.
*B63H 23/34* (2006.01)
*B63H 1/15* (2006.01)
*B63H 23/06* (2006.01)

(52) U.S. Cl.
CPC ..... *B63H 23/34* (2013.01); *B63H 1/15* (2013.01); *B63H 23/06* (2013.01)

(58) Field of Classification Search
CPC ... B63H 1/00; B63H 1/02; B63H 1/12; B63H 1/14; B63H 1/15; B63H 23/00; B63H 23/06; B63H 23/32; B63H 23/321; B63H 23/327; B63H 23/34; B63H 23/342
USPC ..... 440/49, 52, 76, 78, 79, 81, 83
See application file for complete search history.

(56) References Cited

U.S. PATENT DOCUMENTS

| | | | | |
|---|---|---|---|---|
| 2,766,715 | A | 10/1956 | Wateryal | |
| 4,792,313 | A | 12/1988 | Meisenburg | |
| 4,832,636 | A * | 5/1989 | McCormick | B63H 20/00 416/129 |
| 5,408,155 | A * | 4/1995 | Dickinson | F16C 27/08 310/90 |
| 5,630,704 | A | 5/1997 | Gilgenbach et al. | |
| 5,921,828 | A | 7/1999 | Ogino | |
| 6,109,985 | A * | 8/2000 | Dubois | F42B 19/12 416/179 |
| 6,146,223 | A | 11/2000 | Karls | |
| 6,478,543 | B1 * | 11/2002 | Tuchscherer | B63H 23/34 416/134 R |
| 7,086,836 | B1 * | 8/2006 | Sheth | B63H 23/34 416/170 R |
| 7,387,554 | B1 | 6/2008 | Behara et al. | |
| 7,637,792 | B1 | 12/2009 | Davis et al. | |
| 8,267,732 | B1 | 9/2012 | Poirier et al. | |
| 8,277,269 | B1 | 10/2012 | Alby et al. | |
| 10,029,775 | B2 | 7/2018 | Nikmanesh | |
| 10,336,419 | B1 | 7/2019 | Guse et al. | |
| 10,502,312 | B1 | 12/2019 | Jaszewski et al. | |
| D894,055 | S | 8/2020 | George et al. | |
| 10,752,328 | B1 | 8/2020 | Bielefeld et al. | |
| 10,864,976 | B2 | 12/2020 | Burton | |
| 11,247,761 | B1 | 2/2022 | Smith et al. | |
| 11,825,826 | B1 | 11/2023 | Bradford | |

(Continued)

*Primary Examiner* — Daniel V Venne
(74) *Attorney, Agent, or Firm* — Andrus Intellectual Property Law, LLP

(57) ABSTRACT

A propulsor assembly for a marine drive has a propulsor, an adapter having a stem which supports the propulsor, a wear resistant snubber on the stem, and an elastomeric member which is sandwiched between the wear resistant snubber and the stem, the elastomeric member being configured to bias the wear resistant snubber radially outwardly into engagement with the propulsor.

20 Claims, 22 Drawing Sheets

(56) References Cited

U.S. PATENT DOCUMENTS

| | | | |
|---|---|---|---|
| 12,330,750 | B2 | 6/2025 | Cialdella |
| 2024/0262481 | A1 | 8/2024 | Sorkin |

* cited by examiner nose cap

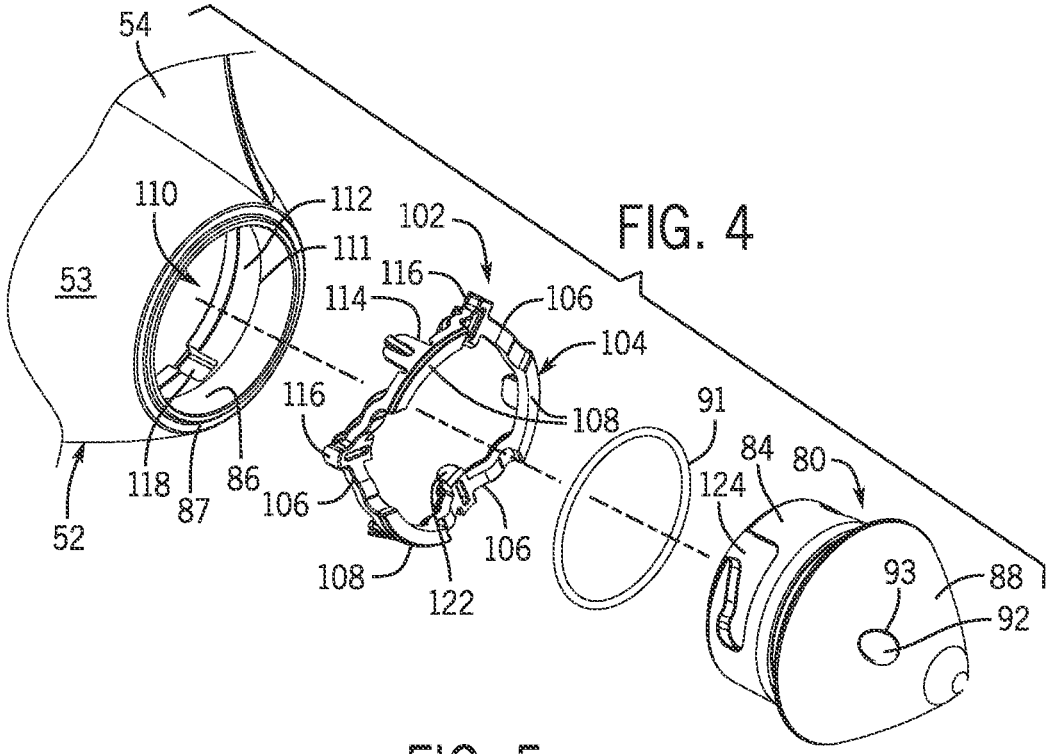
FIG. 4
FIG. 5
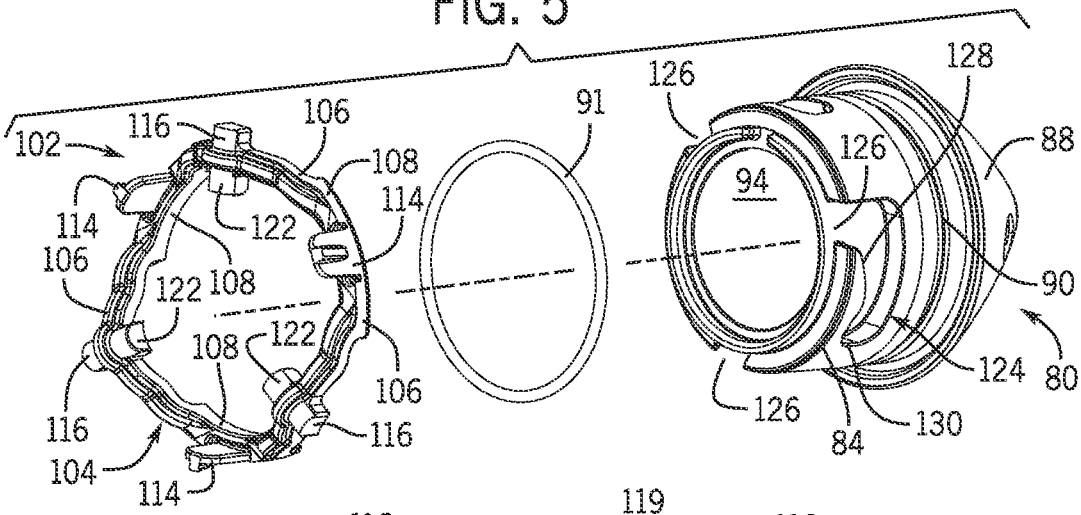
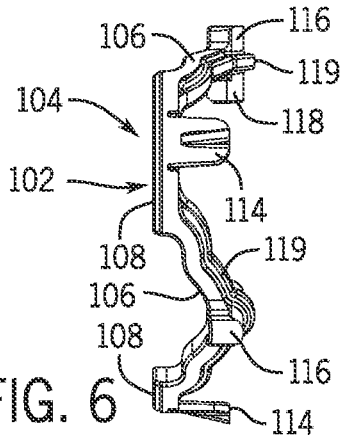
FIG. 6
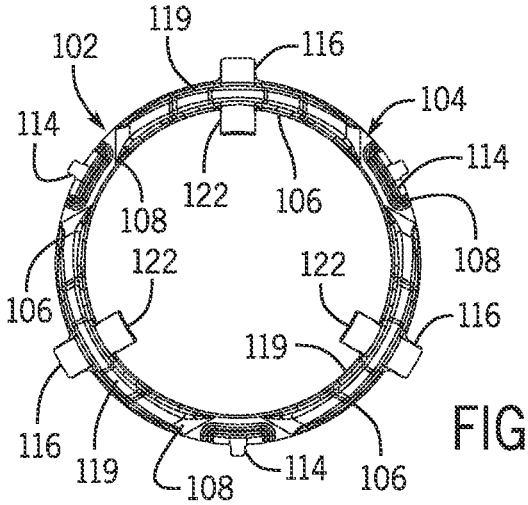
FIG. 7

PROPULSOR ASSEMBLIES HAVING WEAR RESISTANT SNUBBER

FIELD

The present disclosure generally relates to marine drives and more specifically to gearcases and propulsors for marine drives.

BACKGROUND

The following U.S. Patents are incorporated herein by reference in entirety.

U.S. Pat. No. 5,630,704 discloses a shock absorbing drive sleeve which mounts a marine drive propeller to a propeller shaft.

U.S. Pat. No. 8,267,732 discloses a marine drive having a lower gearcase with a vertical drive shaft driving a horizontal propeller shaft in a torpedo housing having a vent plug setting the level of lubricant in the lower gearcase to be substantially at the top of the torpedo housing.

U.S. Pat. No. 10,752,328 discloses a gear mounting assembly for causing rotation of a propeller on a marine drive.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure further provides a gearcase assembly for a marine drive, the gearcase assembly having a gearcase having a torpedo housing, a torpedo plug in the torpedo housing, the torpedo plug separating a lubricant cavity containing lubricant for the gearcase and a water cavity containing cooling water for the marine drive, and a shift actuator configured to actuate a shift clutch in the gearcase, wherein the shift actuator retains the torpedo plug in place relative to the torpedo housing.

In non-limiting embodiments, the shift actuator comprises a shift shaft extending into the gearcase. The shift shaft may extend into engagement with the torpedo plug. The shift shaft may extend through the torpedo plug. The shift actuator may further comprise a bearing which supports rotation of the shift shaft relative to the torpedo plug. The bearing may be one of an upper bearing and a lower bearing, which each support rotation of the shift shaft relative to the torpedo plug. The upper bearing may comprise an upper fitting which extends through a bore in the torpedo housing and through a radial hole in the torpedo plug, such that together the shift shaft and the upper fitting retain the torpedo plug in place relative to the torpedo housing. A seal seals the shift shaft relative to the upper fitting to retain lubricant in the lubricant cavity. The lower bearing may comprise a lower fitting which extends through a radial hole in the torpedo plug and into a bore in the torpedo housing, such that together the shift shaft and the lower fitting retain the torpedo plug in place relative to the torpedo housing. A shaft extension may couple the shift shaft to the lower fitting such that the shift shaft and shaft extension are rotatable relative to the lower fitting.

In non-limiting embodiments disclosed herein, the torpedo plug comprises a sidewall and the shift shaft extends through the sidewall. A seal may be located between the sidewall and the torpedo housing.

In non-limiting embodiments disclosed herein, the torpedo plug may comprise a conical head and an annular stem, the annular stem defining an annular sidewall which abuts an inner wall of the torpedo housing, and wherein the shift shaft extends through the annular sidewall. The gearcase assembly may further comprise an upper bearing and a lower bearing, which each support rotation of the shift shaft relative to the torpedo plug. Both the upper bearing and the lower bearing may extend through the annular sidewall such that together with the shift shaft, the upper bearing and the lower bearing retain the torpedo plug in place relative to the torpedo housing.

The present disclosure further provides a gearcase assembly for a marine drive, the gearcase assembly having a gearcase having a torpedo housing and a torpedo plug in the torpedo housing, the torpedo plug separating a lubricant cavity containing lubricant for the gearcase and a water cavity containing cooling water for the marine drive, a shift actuator configured to actuate a shift clutch in the gearcase, wherein the shift actuator retains the torpedo plug in place relative to the torpedo housing, and a lower water inlet located along a lower surface of the torpedo housing, adjacent the torpedo plug, the lower water inlet configured to receive cooling water into the water cavity. An additional water inlet may be located in a nose of the torpedo housing, the additional water inlet receiving the cooling water into the water cavity. A pump may be provided which draws the cooling water into the water cavity.

Various other features, objects, and advantages will be made apparent from the following description taken together with the drawings.

BRIEF DESCRIPTION OF THE DRAWINGS

The present disclosure includes the following drawing figures:

FIG. 4 is an exploded view of a nose cap and a retainer spring for securing the nose cap to the gearcase of FIG. 3.

FIG. 5 is another exploded perspective view of the nose cap and retainer spring of FIG. 4.

FIG. 6 is a side view of the retainer spring of FIG. 5.

FIG. 7 is a rear view of the retainer spring of FIG. 6.

DETAILED DESCRIPTION

Figure 1:
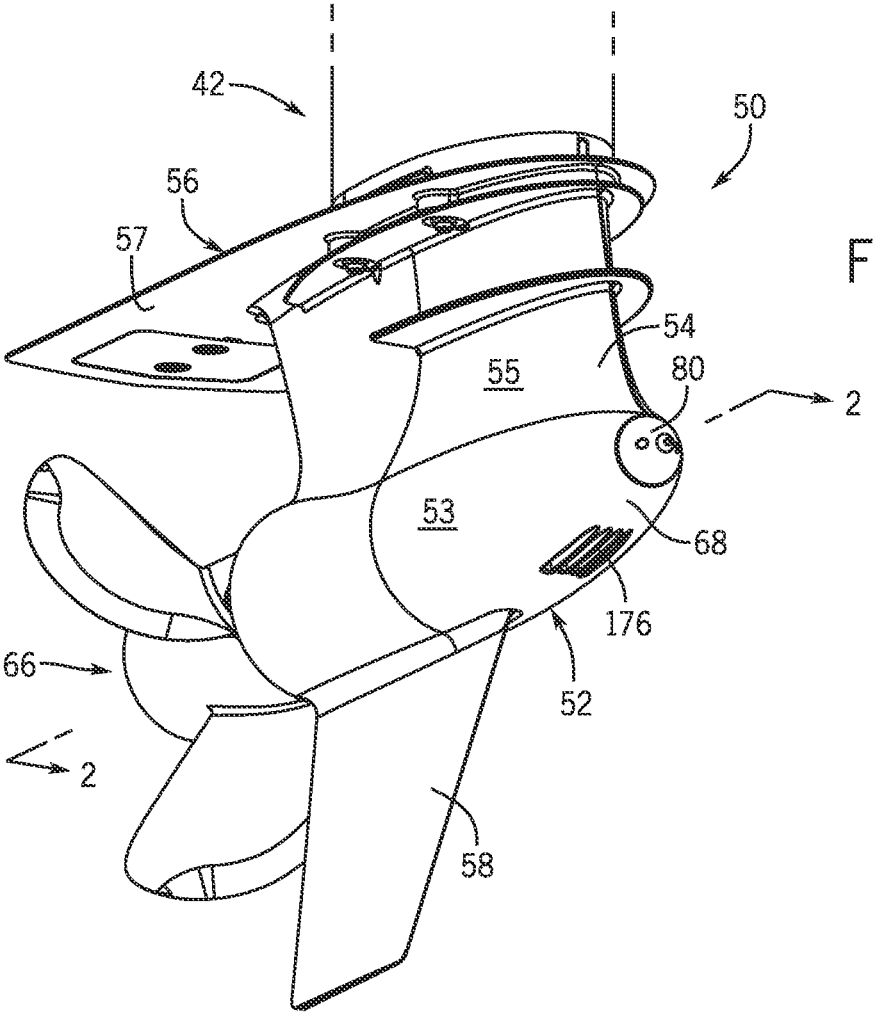
FIG. 1 is a perspective view of a gearcase supported on the upper unit of a marine drive.

FIG. 1 illustrates the gearcase assembly 50 for a marine drive configured to propel a marine vessel (not shown) through the water. In the illustrated embodiment, the gearcase assembly 50 is supported by an upper unit 42 (represented schematically in FIG. 1) of the marine drive, and the upper unit 42 is supported on the transom of the marine vessel. Embodiments of the gearcase assembly 50 may be configured for use with an outboard motor suspended from the transom of the marine vessel, a stern drive having at least a portion that extends through the transom of the marine vessel, and/or any other type of marine drive.

Figure 2:
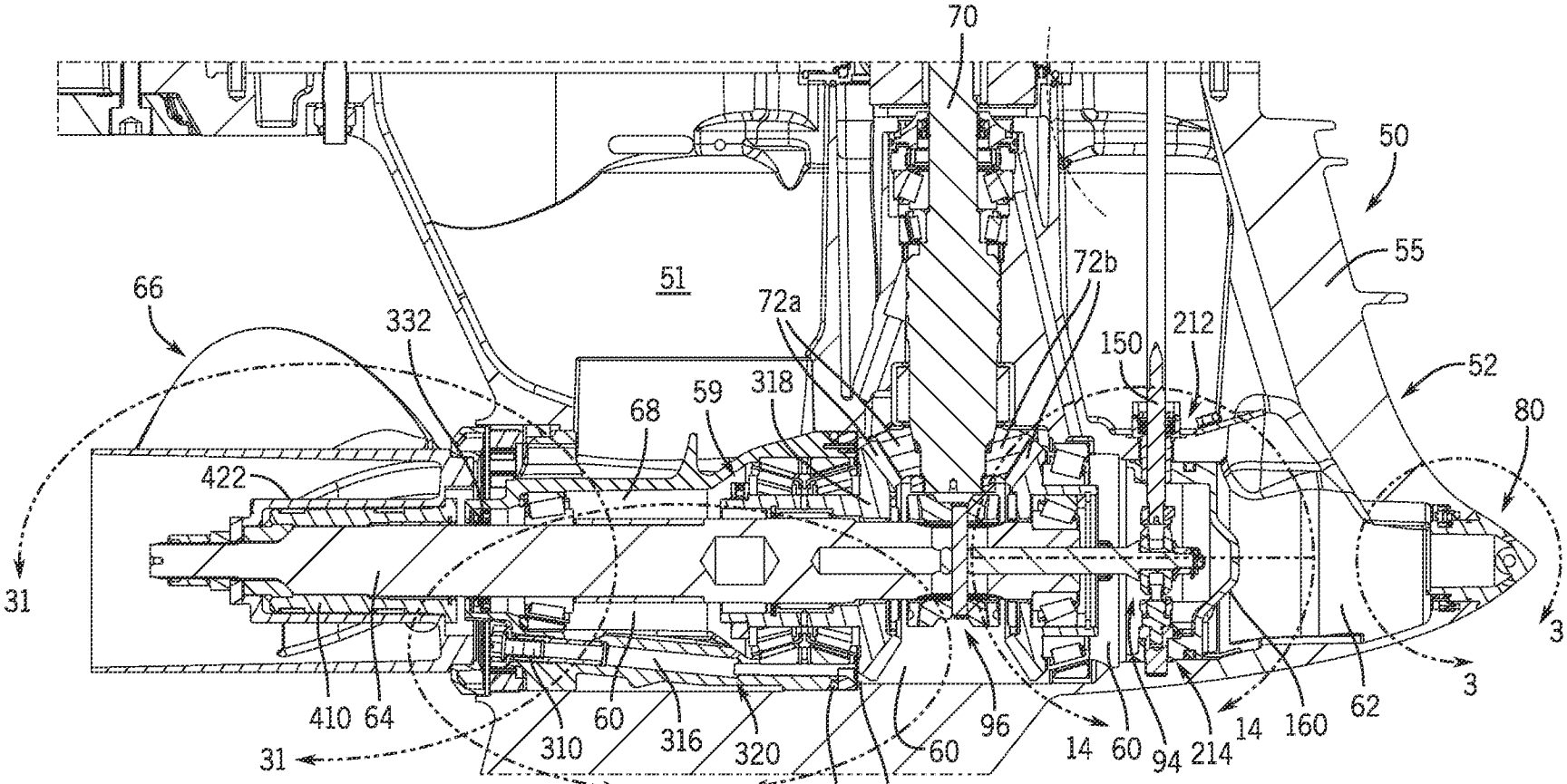
FIG. 2 is a view of section 2-2, taken in FIG. 1.
Figure 8:
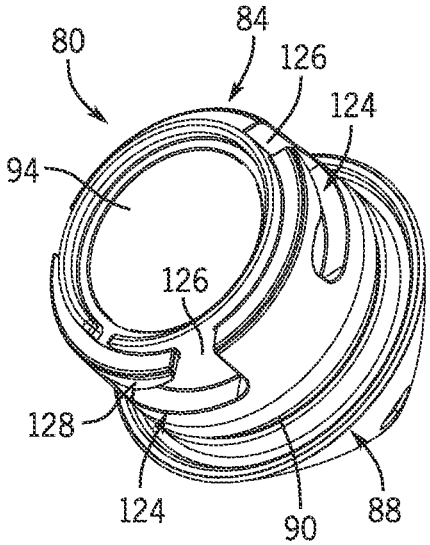
FIG. 8 is a perspective view of the nose cap of FIG. 5.

Referring to FIGS. 1 and 2, the gearcase assembly 50 generally includes a torpedo housing 52 with an outer surface 53 which transitions to an upwardly extending stem 54 and a downwardly extending skeg 58. The gearcase assembly 50 includes an anti-ventilation plate 56 with a generally flat tail 57 which extends rearwardly from the stem 54. The stem 54 has a perimeter sidewall 55 that defines an interior space 51 (FIG. 2) that is located above the torpedo housing 52 and extends upward to the upper unit 42. A driveshaft 70 (FIG. 2) that is operatively connected to an engine or motor or any other type of powerhead (not shown) extends down from the upper unit 42, through the interior space 51 in the stem 54, and into the torpedo housing 52. The torpedo housing 52 has a generally cylindrical body that tapers into a nosecone 68 at the front end of the torpedo housing 52. The torpedo housing 52 and the stem 54 have a smooth outer surfaces which are streamlined and configured to minimize hydrodynamic drag as the marine vessel travels through the water.

Referring to FIG. 2, a sealed gearcase compartment 59 is located withing the torpedo housing 52 and includes a lubricant cavity 60 containing lubricant for the gearcase assembly 50 and a water cavity 62 containing cooling water for the marine drive. As discussed in further detail below, a torpedo plug 160 in the torpedo housing 52 separates the lubricant cavity 60 from the water cavity 62.

The driveshaft 70 extends downward into the gearcase compartment 59 and is operatively connected to an output shaft 64. The output shaft 64 is rotationally supported within the lubricant cavity 60 and extends transversely relative to the driveshaft 70 and out from the back end of the torpedo housing 52. A propulsor 66 is supported on the output shaft 64 and is configured to generate thrust in the water for propelling the marine vessel. A first beveled gearset 72*a* in the lubricant cavity 60 operatively couples the lower end of the driveshaft 70 to the output shaft 64 through the shift clutch 96 so that rotation of the driveshaft 70 by a motor (not shown) causes rotation of the output shaft 64 in a first rotational direction, which in turn causes rotation of the propulsor 66. A second beveled gearset 72*b* in the lubricant cavity 60 operatively couples the lower end of the driveshaft 70 to the output shaft through the shift clutch 96 so that rotation of the driveshaft 70 by the motor (not shown) causes rotation of the output shaft 64 in a second rotational direction which in turn causes opposite rotation of the propulsor.

With continued reference to FIGS. 1 and 2, the gearcase assembly 50 includes a shift clutch 96 and a shift actuator 98 (FIG. 21G) positioned withing the lubricant cavity 60. The shift clutch 96 is configured to allow the marine drive to switch between gears, for example to switch between forward and revers propulsion modes. The shift actuator 98 is configured to actuate the shift clutch 96 to shift gears. The shift clutch 96 is controlled via a shift shaft 150 which extends down from the upper unit 42, through the stem 54, and into the lubrication cavity 60 of the gearcase compartment 59 in the torpedo housing 52. Rotation of the shift shaft 150 by the shift actuator 98 in a first rotational direction causes the shift clutch 96 to move in a first direction within the lubricant cavity 60 to couple a first bevel gearset 72*a* to the output shaft 64. Rotation of the shift shaft 150 in a second rotational direction opposite the first direction causes the shift clutch 96 to move in a second, opposite direction to couple an opposite, second bevel gearset 72*b* to the output shaft 64.

As previously mentioned, the gearcase assembly 50 includes an internal water cavity 62 configured to hold water that can be used to cool various portions of the marine drive, including for example the torpedo housing 52 and the components housed therein, the driveshaft 70, the upper unit 42 and any components housed therein, batteries (not shown) and other electrical components, and/or the motor (not shown).

During research and development in the field of marine drives, the present inventors determined that in some applications, for example when a marine drive is mounted high on the transom of a marine vessel, the water flow into the water cavity may be reduced. This may result in the water pressure within the water cavity dropping below a desired pressure level, which may negatively affect performance of the marine drive. The desired flow rate of water into the water cavity for a marine drive may vary based on the conditions of that marine drive's use. Through their research and experimentation, the present inventors determined that it would be advantageous to provide a gearcase that can be easily reconfigured to adjust the flow rate of water entering the gearcase to maintain water pressure. The present disclosure is a result of the present inventors' efforts in this regard.

Figure 3:
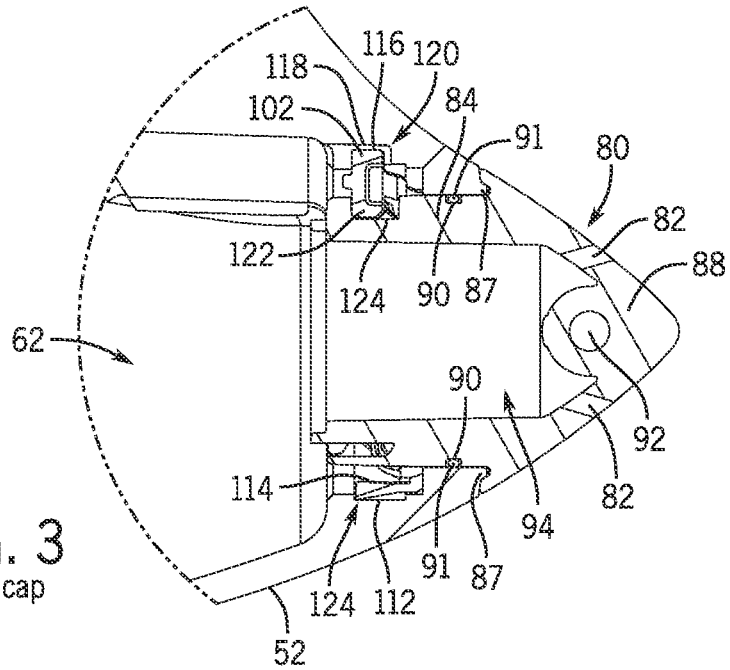
FIG. 3 is view of detailed section 3-3, taken in FIG. 2.

Referring to FIGS. 1-3, the illustrated gearcase assembly 50 includes a novel nose cap 80 that forms a portion of the nosecone 68 of the torpedo housing 52. The nose cap 80 may include at least one through-bore 82 for conveying water into the gearcase assembly 50 for cooling the marine drive. The nose cap 80 is removably coupled to the torpedo housing 52 via a novel retainer device 102 such that the nose cap 80 may be replaced or swapped for a differently configured nose cap 80 (see, e.g., FIGS. 9A-10B). Referring to FIGS. 3-5, a retainer spring (i.e., the retainer device 102) is located between the nose cap 80 and the torpedo housing 52 and extends around the bore 86 in the nose of the torpedo housing 52. The retainer spring 102 is configured to bias the nose cap 80 onto the torpedo housing 52 and retain the nose cap 80 thereon. As discussed in further detail below, the illustrated retainer spring 102 is engaged with and retains the nose cap 80 on the torpedo housing 52 via a twist-lock interface between the nose cap 80 and the retainer spring 102.

Referring to FIGS. 3-5, the nose cap 80 has a stem 84 dimensioned to fit into a bore 86 formed through the nose of the torpedo housing 52 and a head 88 that forms a tip of the nosecone 68. The stem 84 has a generally cylindrical outer surface and defines an interior cap cavity 94 which opens into the water cavity 62 through the back end of the nose cap 80. A groove 90 (FIGS. 9A and 9B) is formed around the radially outer surface of the stem 84. An O-ring 91 is seated in the groove 90 and is configured to form a seal between the radially outer surface of the stem 84 and the radially inner surface of the bore 86 in the torpedo housing 52, as illustrated in FIG. 3.

Figure 9A:
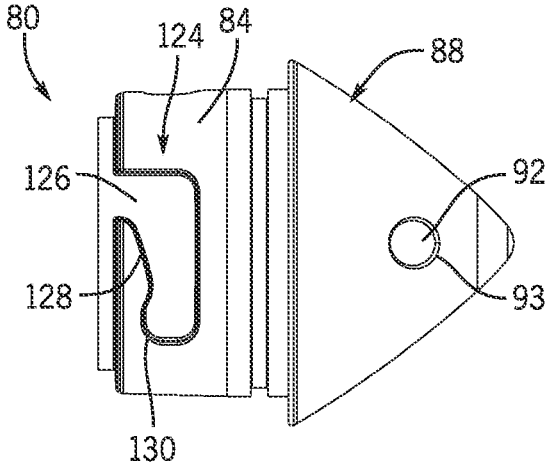
FIG. 9A is a side view of an embodiment of a nose cap configured with a pointed nose.
Figure 9B:
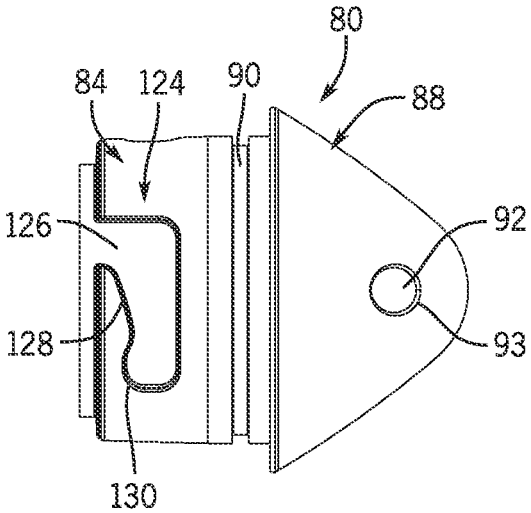
FIG. 9B is a side view of an embodiment of a nose cap configured with a rounded nose

The head 88 of the nose cap 80 at least partially overlaps a forward edge 87 of the torpedo housing 52 and is evenly tapered relative to the outer surface 53 of the torpedo housing 52. Thus, the nose cap 80 and the torpedo housing 52 together have a smooth outer profile. This may be useful, for example, to provide a smooth, generally continuous nosecone surface 68 to prevent cavitation from occurring on the surface of the nosecone 68 and reduce hydrodynamic friction. As illustrated in FIGS. 9A and 9B, the shape and size of the head 88 may vary based on the parameters and conditions of the marine drive's use. For example, the nose cap 80 of FIG. 9A has a generally pointed head 88. This may be useful, for example, in high velocity applications and/or to reduce hydrodynamic skin drag on the torpedo housing 52. The nose cap 80 of FIG. 9B is configured with a generally rounded head 88. This may be useful, for example, in lower velocity applications and/or to help prevent the formation of low-pressure zones around the nose cap 80, thereby reducing hydrodynamic pressure drag. Additionally or alternatively, embodiments may be configured with a nose cap and torpedo housing that provide a nosecone that is differently shaped and/or sized than those of the illustrated embodiments.

Figure 10A:
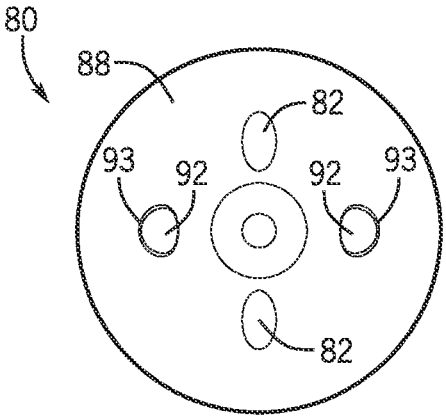
FIG. 10A is a front view of an embodiment of a nose cap configured with two through-bores for conveying water into a water cavity in the gearcase.
Figure 10B:
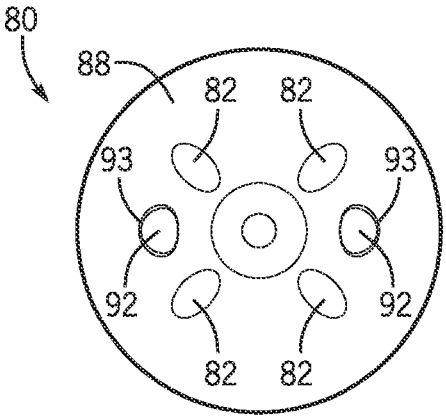
FIG. 10B is a front view of an embodiment of a nose cap configured with four through-bores for conveying water into a water cavity in the gearcase.

Referring to FIGS. 10A and 10B, at least one through-bore 82 is formed through the head 88 of the nose cap 80 from the outer surface of the head 88 to the interior cap cavity 94. The cap cavity 94 opens into the water cavity 62 of the gearcase assembly 50, thereby providing a flow path for water into the water cavity 62 via the through-bore(s) 82 and the cap cavity 94. The through-bores 82 are configured to convey water through the nose cap 80 and into the water cavity 62 of the gearcase assembly 50. Embodiments of a nose cap 80 may be configured with different numbers, shapes, sizes, and/or types of through-bores 82. For example, in FIG. 10A the illustrated nose cap 80 includes two through-bores 82 spaced evenly around the head 88 of the nose cap 80. The two through-bores 82 are formed through opposite sides of the nose cap 80 and are each offset from the openings 93 into the transverse fastening bore 92 by approximately ninety degrees. In FIG. 10B, the illustrated nose cap 80 includes four through-bores 82 which are evenly spaced around the nose cap 80 so that they are approximately ninety degrees apart from each other. The four through-bores 82 are arranged symmetrically relative to the openings 93 into the transverse fastening bore 92 such that each opening 93 is positioned approximately 45 degrees apart from the adjacent through-bores 82. Some embodiments may be configured to not have a transverse fastening bore 92 if leverage for installation can be achieved by other means; such as via a spanner wrench (now shown) that has pins that engage two or more through-bores 82

The number, shape, size, and position of the through-bore (s) 82 may vary in different embodiments of the nose cap 80 based on the desired flow rate of water into the water cavity 62 via the through-bores 82, the desired water pressure in the water cavity 62, the operational parameter(s) and condition (s) of the marine drive, and/or any other factors. Some embodiments of a nose cap may have at least one through-bore that is configured differently than those of the illustrated embodiments. For example, a nose cap may include at least one through-bore that is differently shaped and/or sized than those of the illustrated embodiments. Embodiments of a nose cap may include a different number of through-bores than those of the illustrated embodiment, and at least one through-bore may be different than at least one other through-bore. Some embodiments of a nose cap may include through-bores positioned in different locations and/or arranged in different patterns than those of the illustrated embodiments. Further still, some embodiments may omit a through-bore, which may be useful, for example. when reduced flow into the water cavity 62 is desired.

Referring to FIGS. 4-7, the retainer spring 102 has a resiliently deformable annular body 104 that fits within the interior of the torpedo housing 52. The illustrated retainer spring 102 is configured as a curved wire from which the various engagement features and tabs extend. In particular, the annular body 104 of the retainer spring 102 is configured as a circular wire ring. Other embodiments, however, may be differently configured. The illustrated retainer spring 102 includes three deformable segments 106 that are spaced evenly around the annular body 104 and three rigid segments 108 are formed between the deformable segments 106. The deformable segments 106 are generally horseshoe-shaped and extend reward from the rigid segments 108 towards the rear of the torpedo housing 52. The horseshoe shape enables the deformable segments 106 to deflect forward towards the plane of the rigid segments 108 when a force is applied, for example when attaching or removing a nose cap 80. It should be noted that the rigid segments 108 may be resiliently deformable like the deformable segments 106 but are configured to retain their shape when attaching or removing a nose cap 80. At least one rib 119 may be formed on the axially top or bottom surface of the annular body 104. This may be useful, for example, to provide the desired rigidity to deformable segments 106 and/or the rigid segments 108 of the retainer spring 102. Some embodiments of a gearcase assembly 50 may include a differently configured retainer spring 102 and/or a different type of retainer device or devices.

Referring to FIGS. 3-7, the retainer spring 102 is located radially between the nose cap 80 and the torpedo housing 52 when the nose cap 80 is installed on the gearcase assembly 50 (FIG. 3). In particular, the illustrated retainer spring 102 is received in an annular slot 112 (FIG. 11A) formed around the radially inner surface of an interior counterbored portion 110 of the bore 86 through the front of the torpedo housing 52. The rigid segments 108 of the retainer spring 102 are seated on a forward edge 111 of the counterbored portion 110. To secure the retainer spring 102 in position in the torpedo housing 52 and around the bore 86, a plurality of attachment features 114, 116 extend radially outward from the annular body 104. Snap-fit tabs 114 extend from each of the rigid segment 108 and engage the annular slot 112 to secure the retainer spring 102 in the counterbored portion 110, thereby preventing axial movement of the retainer spring 102 relative to the bore 86. A positioning member 116 projects radially outward from a radially outer surface of each deformable segment 106 to engages a slot 118 (FIG. 11A) formed in the radially inner surface of the bore 86, thereby preventing the retainer spring 102 from rotating relative to the bore 86.

As previously mentioned, the nose cap 80 is removably coupled to the torpedo housing 52 via a retainer device 102 with a twist-lock interface between the nose cap 80 and the retainer spring 102. In the illustrated embodiments, for example, the twist-lock interface between the nose cap 80 and the retainer spring 102 includes a cam device 120 configured to bend the deformable segment 106 of the retainer spring 102 as the nose cap 80 is twisted into the installed position on the torpedo housing 52. The cam device 120 has corresponding portions on the retainer spring 102 and the stem 84 of the nose cap 80. Referring to FIGS. 4-7, the illustrated cam device 120 includes a plurality of engagement fingers 122 that projects radially inward from a radially inner surface of the annular body 104 of the retainer spring 102. Each of the engagement fingers 122 is positioned proximate the apex of one of the deformable segments 16 of retainer spring 102 such that the engagement fingers 122 move with the deformable segments when they are deflected.

Referring to FIGS. 4, 5, and 8-9B, the nose cap 80 includes a plurality of ramped slots 124, each one corresponding to an engagement finger 122 on the retainer spring 102. Each ramped slot 124 includes a channel 126 which receives the engagement finger 122 into the ramped slot 124 as the nose cap 80 is inserted into the torpedo housing 52 and a ramp 128 is formed adjacent the channel 126.

The ramp 128 is sloped towards the head 88 of the nose cap and is configured so that the engagement finger 122 rides along the ramp 128 as the nose cap 80 is twisted relative to the torpedo housing 52. Engagement between the ramps 128 and the engagement fingers 122 compresses the retainer spring 102 causing the deformable segments 106 to bend forward. The ramped slots 124 each include a pocket 130 formed at the end of the ramp 128. The pockets 130 are configured to receive a corresponding engagement finger 122 as said engagement finger 122 reaches the end of the ramp 128. When the nose cap 80 is rotated within the bore 86 to slide the engagement fingers 122 along the ramp 128 and into the pocket 130, the engagement fingers 122 are biased into engagement with the pocket 130, thereby resisting rotation of the nose cap 80 relative to the torpedo housing 52.

In the illustrated embodiments, the cam device 120 is configured with the engagement fingers 122 positioned on the retainer spring 102 and the corresponding ramped slots 124 formed in the torpedo housing 52. Some embodiments, however, may be configured with the reverse arrangement. For example, at least one engagement finger may project outward from the nose cap 80 and a corresponding ramped slot may be formed in the retainer spring 102. Additionally or alternatively, a gearcase may be configured with a retainer spring that is fixed to the nose cap and which slides into the torpedo housing. Further still, some embodiments may include at least one different set of engagement features for coupling the nose cap to the gearcase assembly 50.

Figure 11A:
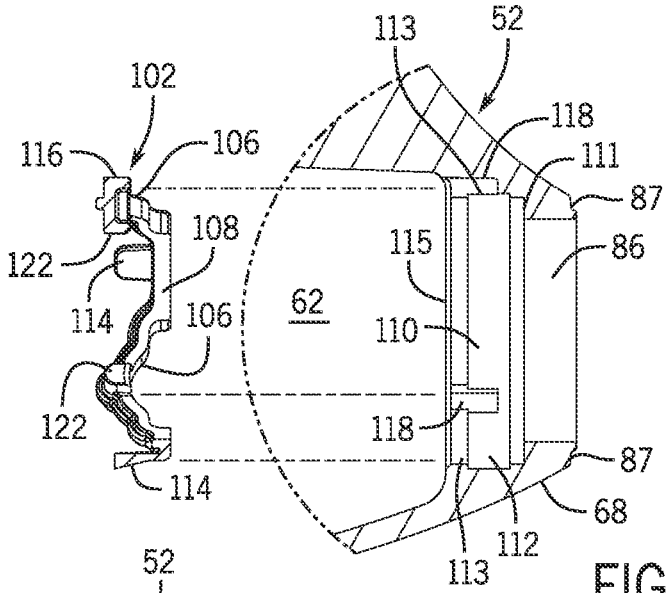
FIGS. 11A-11C are views of detailed section 3-3, taken in FIG. 2 illustrating the process for inserting the retainer ring and the nose cap onto the gearcase.

Referring to FIGS. 11A-13C, to couple a nose cap 80 on the gearcase assembly 50, the retainer spring 102 is first installed on the torpedo housing 52. Referring to FIG. 11A, the retainer spring 102 is moved into the interior of the nosecone 68 via the back end of the torpedo housing 52. The positioning members 116 projecting radially outward from the annular body 104 of the retainer spring 102 are aligned with the corresponding slots 118 and the retainer spring 102 is moved forward into the counterbored portion 110 of the bore 86 through the torpedo housing 52. As the positioning members 116 enter the corresponding slots 118, engagement between the positioning members 116 and the corresponding slots 118 prevents rotation of the retainer spring 102 in the bore 86. As the retainer spring 102 moves into the counterbored portion 110, the snap-fit tabs 114 abut a rear edge 115 of the counterbored portion, which biases the snap-fit tabs 114 radially inward. Once the tabs are past the rear edge 115, they snap radially outward to engage an edge 113 of the annular slot 112, thereby securing the retainer spring 102 in the bore 86 on the interior of the gearcase assembly 50.

Figure 11B:
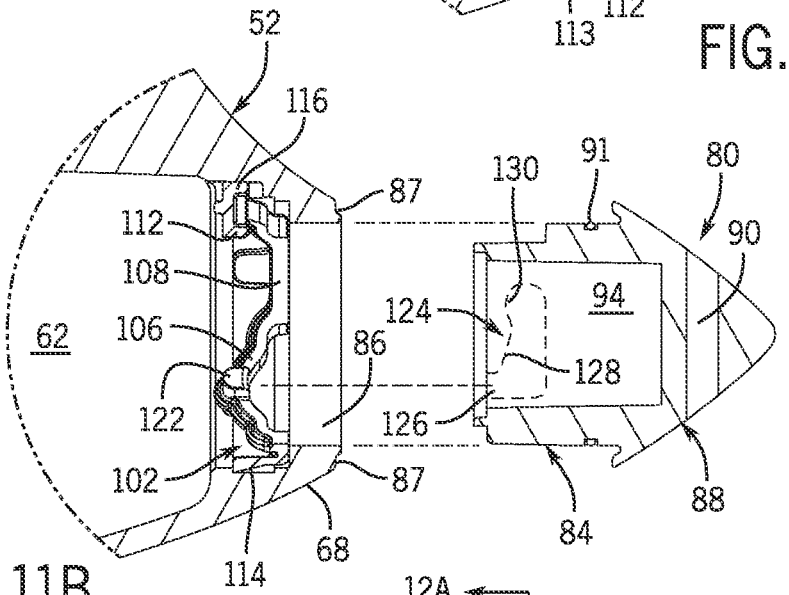
Figure 11C:
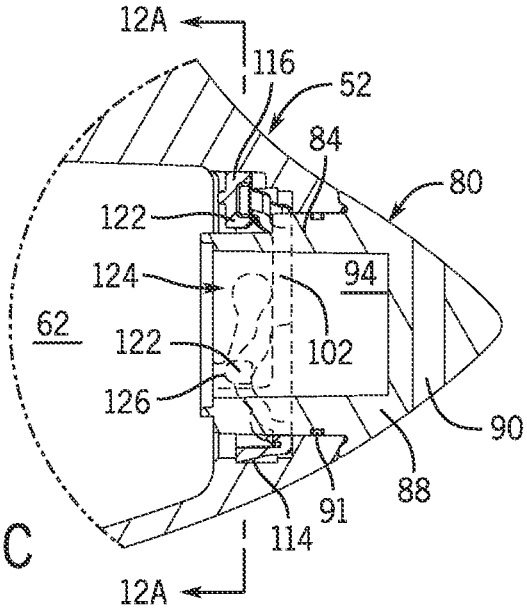

Referring to FIGS. 11B and 11C, the nose cap 80 can then be moved into the bore 86 in the nosecone 68 from the exterior of the torpedo housing 52. The nose cap 80 is rotated until the channels 126 into the ramped slots 124 are each aligned with an engagement finger 122 projecting radially inward from the retainer spring 102. As the stem 84 enters the bore 86, the engagement fingers each slide into the corresponding channel 126. In this position, illustrated in FIG. 11C, the retainer spring 102 is located radially between the nose cap 80 and the torpedo housing 52. The O-ring 91 is compressed between the stem 84 of the nose cap 80 and the radially inner surface of the bore 86, thereby forming a seal between the stem 84 and the torpedo housing 52.

Figure 12A:
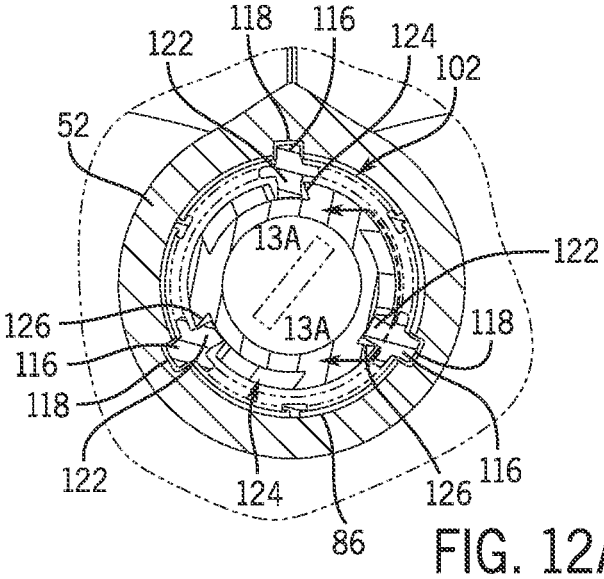
FIGS. 12A-12C are views of section 12A-12A, taken in FIG. 11C, illustrating steps for rotating the nose cap into the installed position.
Figure 13A:
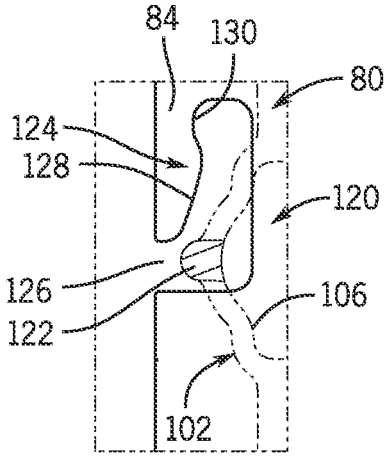
FIGS. 13A-13C are views of section 13A-13C, respectively taken in FIGS. 12A-12A, illustrating steps for rotating the nose cap into the installed position.
Figure 12B:
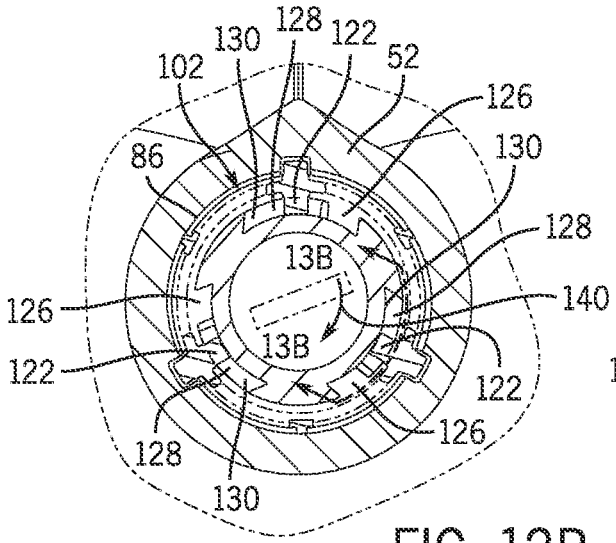
Figure 13B:
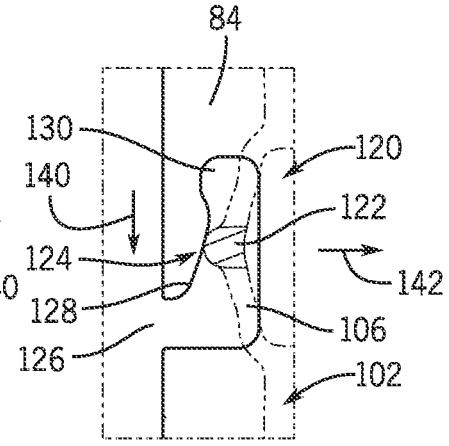

Once the nose cap 80 is fully inserted into the bore 86 in the front of the torpedo housing 52, as illustrated in FIGS. 12A and 13A, the nose cap 80 can be rotated within the bore 86 into an installed position. Referring to FIGS. 12B and 13B, as the nose cap 80 is twisted in the direction of arrow 140, each engagement finger 122 engages and rides up the ramp 148 in the corresponding ramped slot 124. As the engagement fingers 122 slide along the ramps 128, abutment between the engagement fingers 122 and the ramps 128 presses the engagement fingers 122 forward in the direction of arrow 142 (FIG. 13B), thereby bending the deformable segments 106 of the retainer spring 102 forward. Engagement between the engagement fingers 122 and the ramps 128 also presses the nose cap 80 backwards and into engagement with the torpedo housing 52.

Figure 12C:
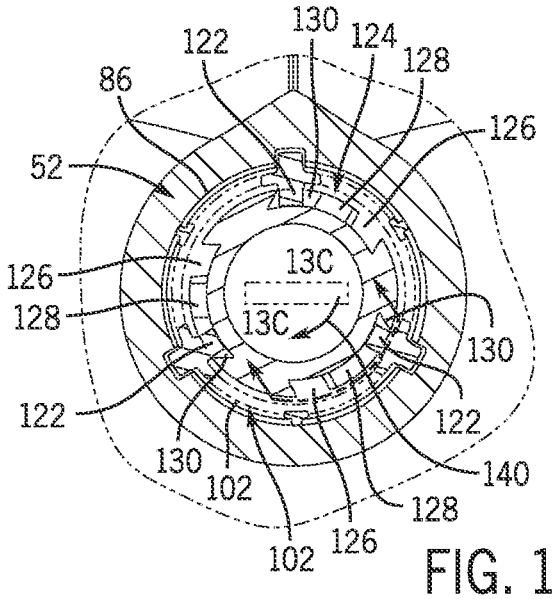
Figure 13C:
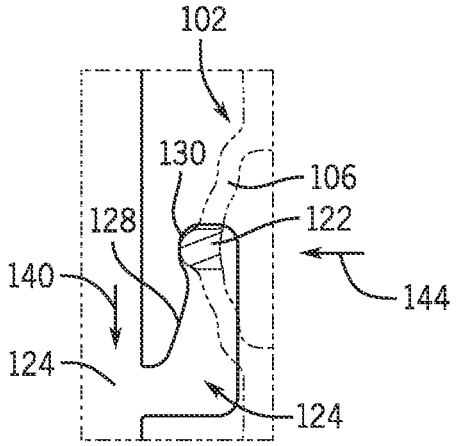

Referring to FIGS. 12C and 13C, continued rotation of the nose cap 80 in the direction of arrow 140 forces the engagement fingers 122 to slide further up the ramps 128 until the engagement fingers 122 reach the corresponding pockets 130, thereby placing the nose cap 80 into the installed position. As each engagement finger 122 moves past the end of the corresponding ramp 128, pressure on the deformable segment 106 is released causing the engagement finger 122 to spring rearward into the pocket 130 of the ramped slot 124 as the deformable segment 106 to deflects back towards its unbent configuration. With the nose cap 80 in the installed position, the deformable segment 106 of the retainer spring 102 is still at least slightly bent, pressing the engagement fingers 122 against the interior of the pockets 130. This engagement between the engagement fingers 122 and the pockets 130 continues to press the nose cap 80 towards the rear of the torpedo housing 52. This may be useful, for example, to snugly retain the nose cap 80 in position on the torpedo housing 52, and to minimize any gaps between the torpedo housing 52 and the nose cap 80 to prevent cavitation from occurring on the nosecone 68.

Thus, the novel gearcase assembly 50 of FIGS. 1-13C provide a system for easily removing and replacing a nose cap 80 on the nosecone 68 of a torpedo housing 52. The twist lock arrangement between the retainer spring 102 and the nose cap 80 snugly retains the nose cap 80 on the torpedo housing 52 while still allowing for the quick removal of the nose cap. This may be useful, for example, to reconfigure a gearcase assembly 50 based on a desired water flow into the water cavity and water pressure therein. It will be understood by those having ordinary skill in the art, that the retainer spring 102 biases the nose cap 80 onto the torpedo housing 52, wherein the retainer spring 102 remains on the torpedo housing 52 in a position for receiving the nose cap 80 when the nose cap 80 is removed therefrom. Each nose cap 80 may be one of a plurality of interchangeable nose caps 80 that each have a different arrangement of through-bores 82 for conveying water into the water cavity 62. Nose caps may be configured with through-bores 82 that are shaped, sized, and positioned in the nose cap 80 based on the desired parameters for the cooling system. In some embodiments, it may be advantageous to use a nose cap 80 that permits more water into the water cavity when the marine drive is configured for a high-speed application in which a larger portion of the gearcase assembly 50 is above the waterline. In other situations, it may be advantageous to use a nose cap 80 that permits less water into the water cavity.

As previously mentioned, the shift actuator 98 includes a shift shaft 150 that extends down from the upper unit 42 and into the gearcase assembly 50. Referring to FIGS. 2 and 14-16, the shift actuator 98 includes an actuator shaft 202 with one end connected to the output shaft 64 (FIG. 2) and an opposite end including a crank collar 204 and a crank yoke 206 that engages an annular slot 205 formed around the crank collar 204. The shift shaft 150 is operatively linked to the crank yoke 206 such that rotation of the shift shaft 150 causes corresponding rotation of the crank yoke 206. As the crank yoke 206 rotates, the portion of the crank yoke 206 engaging the annular slot 205 shifts forwards or backwards relative to the axis of rotation of the shift shaft 150, thereby causing the crank collar 204 to correspondingly slide towards the front or back of the torpedo housing 52. The crank collar 204 is axially fixed on the actuator shaft 202 such that the actuator shaft 202 moves with the crank collar 204 when the crank yoke 206 is rotated. As the actuator shaft 202 moves forwards or backwards within the lubricant cavity 60, it pushes or pulls the shift clutch 96, thereby causing the marine drive to shift gears.

Figure 14:
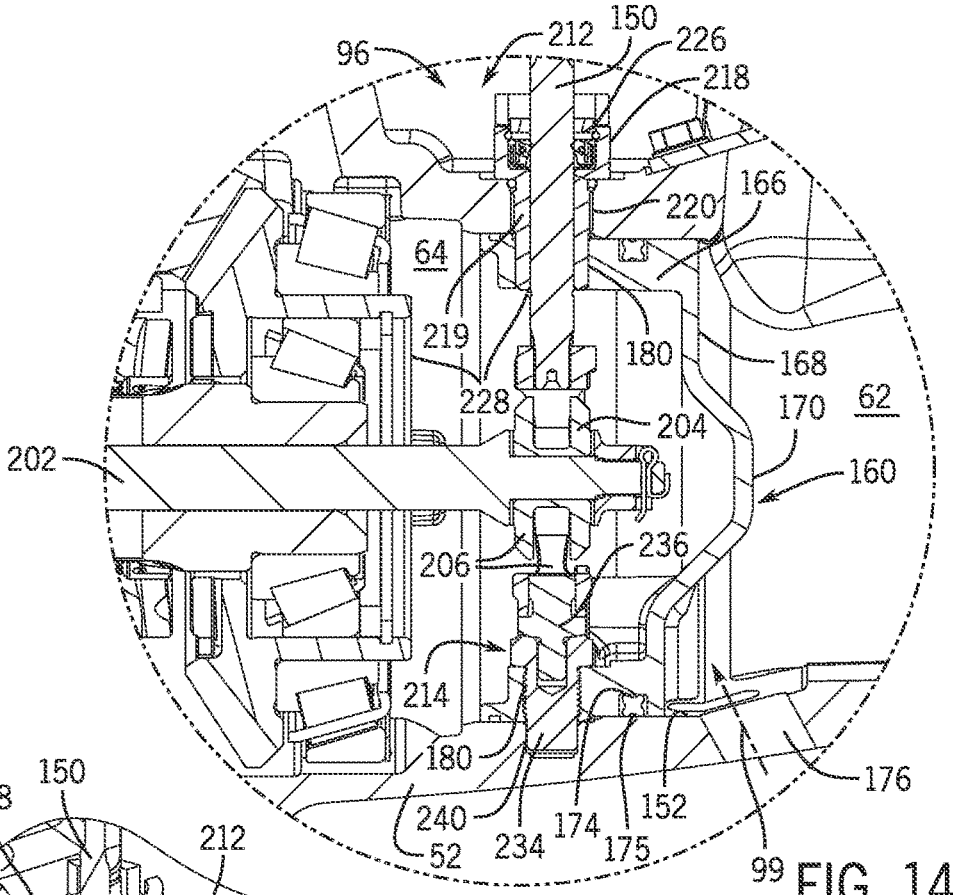
FIG. 14 is view of detailed section 14-14, taken in FIG. 2, illustrating the shift actuator and torpedo plug.
Figure 15:
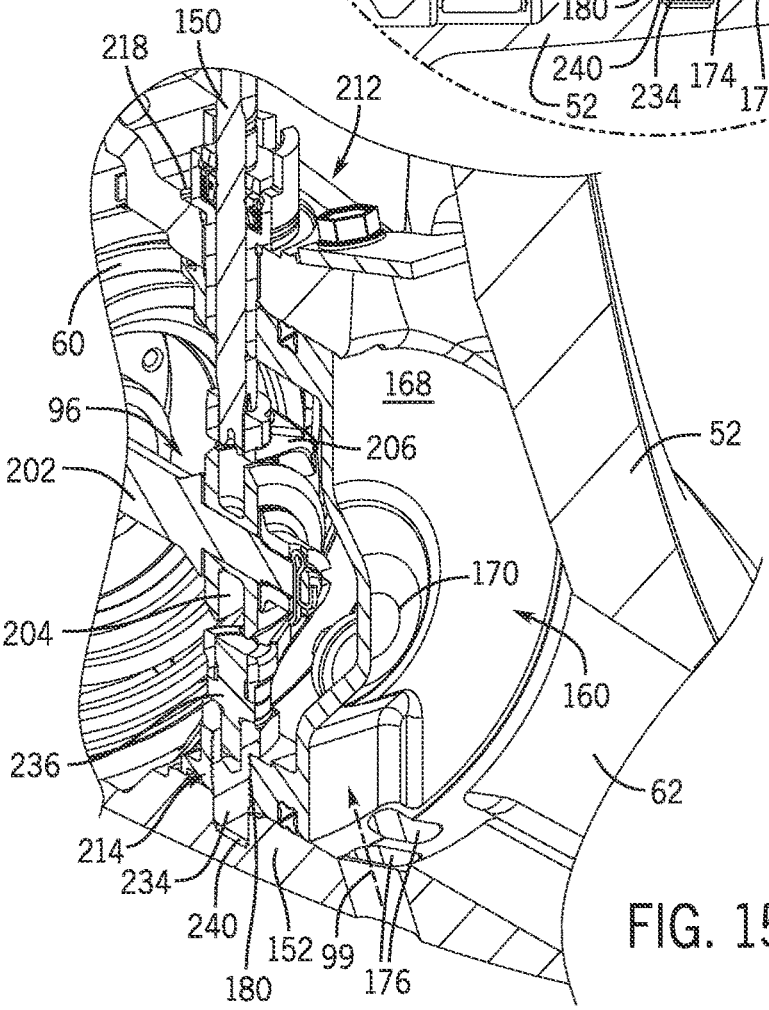
FIG. 15 is a perspective view of the cross-section of FIG. 14

As illustrated in FIGS. 14 and 15, some embodiments of a gearcase assembly 50 may be configured with a novel torpedo plug 160 that separates the lubricant cavity 60 from the water cavity 62 and is engaged by a portion of the shift actuator 98 to retain the torpedo plug 160 in position within the gearcase assembly 50. Referring to FIGS. 14, 15, and 18-20, the torpedo plug 160 includes an annular stem 162 that defines an annular side wall 164 which abuts an inner wall 152 of the torpedo housing 52 (FIGS. 2, 14, and 15). A groove 174 formed around a radially outer surface of the annular side wall 164 is configured to receive a seal member 175 configured to form a seal between the torpedo plug 160 and the inner wall 152 of the torpedo housing 52 to prevent water and/or lubricant from flowing around the torpedo plug 160. In the illustrated embodiments, the seal member 175 is configured as a quad seal 1775 having a generally X-shaped profile. Some embodiments, however, may be configured with a different type of seal member.

The annular side wall 164 of the torpedo plug includes radial holes 180 formed through the top and bottom sides thereof. As discussed in greater detail below, the shift actuator 98 includes components which extend through the radial holes 180 to fix the position of the torpedo plug 160 in the torpedo housing. Each radial hole 180 is surrounded by a boss that extends radially inward from the inner surface of the annular side wall 164. An opening 166 at the back end of the torpedo plug 160 opens into, and forms part of, the lubricant cavity 60. A front wall 168 of the torpedo plug 160 opposite the opening 166 divides the gearcase compartment 59 into the lubricant cavity 60 and the water cavity 62. A conical head 170 is formed in the front wall 168 and projects into the water cavity 62. The front wall 168 also includes a generally rectangular recessed section 172 positioned proximate the bottom side of the torpedo plug 160. As illustrated in FIGS. 14 and 15 and 15, the recessed section 172 provides clearance for lower water inlets 176 formed in the bottom of the torpedo housing 52 adjacent the torpedo plug 160 such that water may enter the water cavity 62 via the water inlets 176 (see also FIG. 1) in the direction of arrow 99. This may be useful, for example, so that water may be conveyed into the water cavity 62 when the marine drive is configured such that the gearcase assembly 50 rides high relative to the water level.

To rotationally support the crank collar 204 and crank yoke 206, the shift actuator 98 includes an upper bearing 212 and a lower bearing 214 that extend through the annular side wall 164 in the torpedo plug 160 to engage the torpedo housing 52. With continued reference to FIGS. 14-17, the upper bearing 212 and the lower bearing 214 are respectively configured to support the upper and lower portions of the shift actuator 98 relative to the torpedo plug 160. The upper bearing 212 includes an upper fitting 218 which engages the torpedo housing 52 and the torpedo plug 160 to rotationally support the shift shaft 150. The upper fitting 218 includes a stem portion 219 that extends through a bore 220 formed in the top side of the torpedo housing 52 and through a corresponding radial hole 180 formed in the top of the torpedo plug 160. The shift shaft 150 extends down through the center of the upper fitting 218 and through the bore 220 in the torpedo housing 52 and the radial hole 180 in the top of the torpedo plug 160 to engage the top of the crank yoke 206. Engagement between the upper fitting 218 and/or the shift shaft 150 and the bore 220 through the torpedo housing 52 and the radial hole 180 in the torpedo plug 160 retains the torpedo plug 160 in place relative to the torpedo housing 52.

Figures 16, 17:
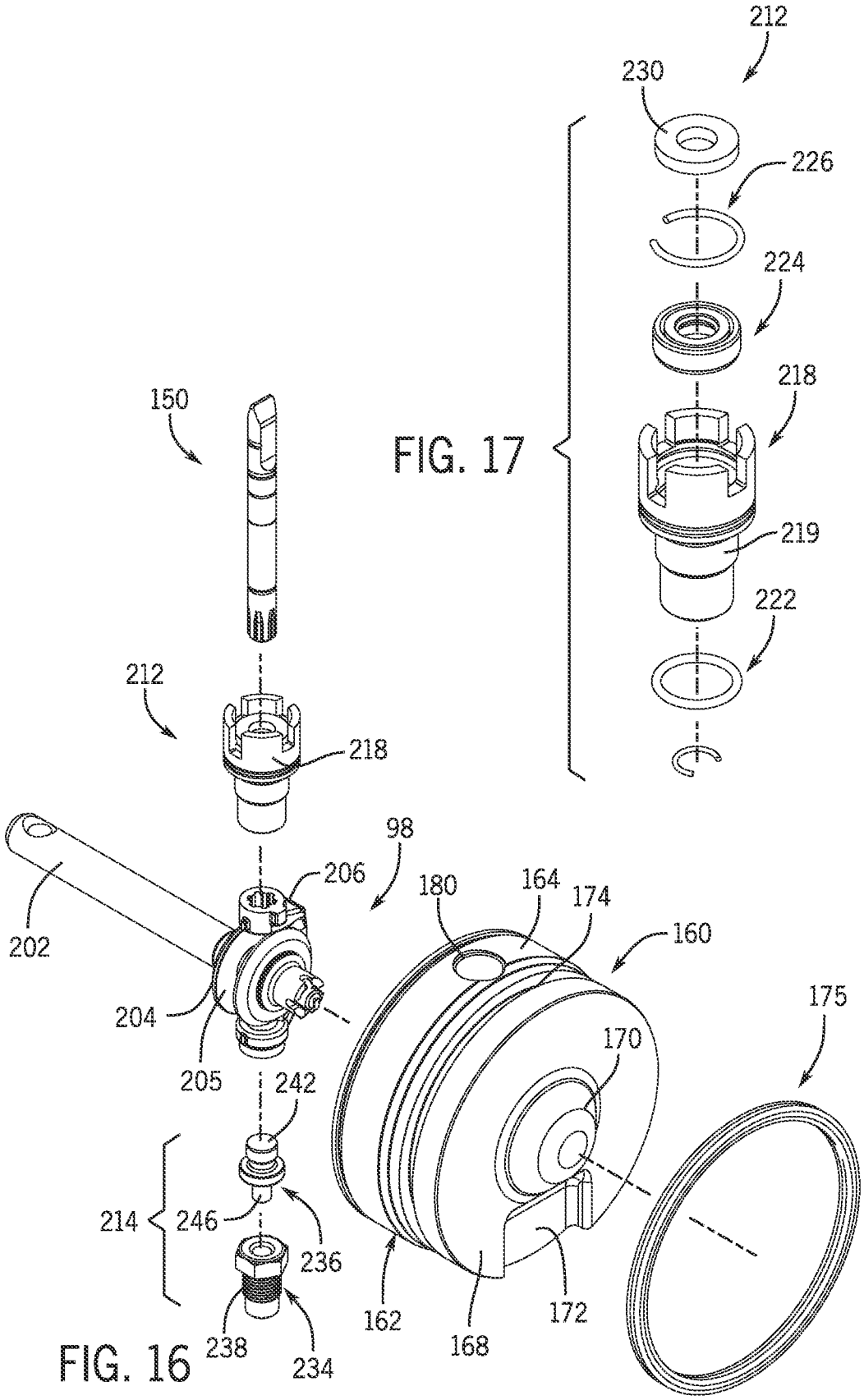
FIG. 16 is an exploded perspective view of the shift actuator and torpedo plug of FIG. 15.
FIG. 17 is an exploded perspective view of the upper bearing from shift actuator of FIG. 16.
Figure 18:
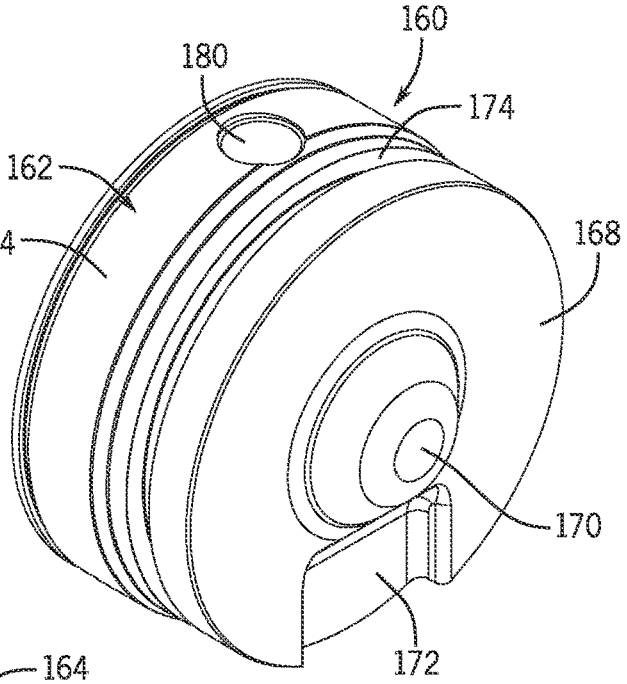
FIG. 18 is a front perspective view of the torpedo plug of FIG. 16.
Figure 19:
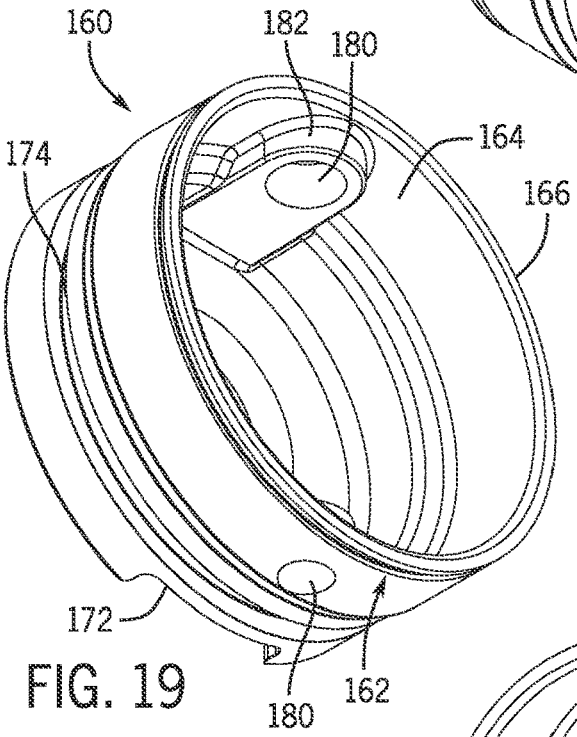
FIG. 19 is a rear perspective view of the torpedo plug of FIG. 18.
Figure 20:
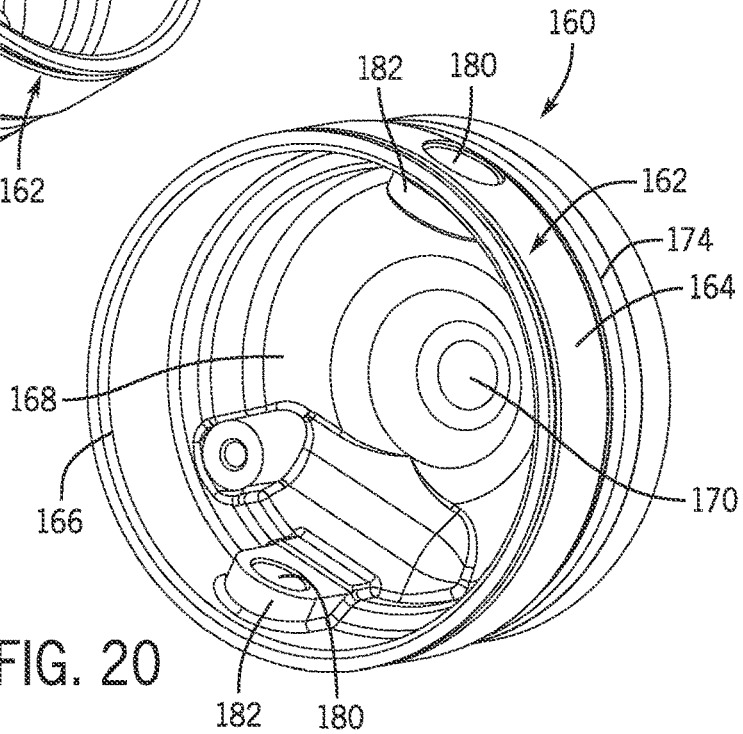
FIG. 20 is another perspective view of the torpedo plug of FIG. 19.

The upper bearing 212 may include at least one seal which seals the shift shaft 150 relative to the upper fitting 218 to retain the lubricant in the lubricant cavity 60 For example, referring to FIG. 17, the upper bearing 212 includes an O-ring 222 configured to form a seal between the upper fitting 218 and the torpedo housing 52. An annular seal member 224 is formed around the shift shaft 150 on the top side of the upper fitting 218 and is configured to form a seal between the shift shaft 150 and the upper fitting 218. An upper C-clip 226 is secured to the upper fitting 218 above the annular seal member 224 to retain the annular seal member 224 in position on the top of the upper fitting 218. A rubber dust seal 230 is positioned above the upper C-clip 226 and the annular seal member 224 and may be configured to restrict the ingress of dust and other debris into the torpedo housing 52. As illustrated in FIG. 14, a lower C-clip 228 may be positioned on the shift shaft 150 below the upper bearing 212 and within the interior of the torpedo plug 160 to retain the shift shaft 150 in the lubricant cavity 60. In some embodiments, at least one of the upper C-clips 226, 228 may rotate with the shift shaft 150.

Referring to FIGS. 14-16, the lower bearing 214 similarly extends through and engages the annular side wall 164 of the torpedo housing 52 while supporting rotation of the shift shaft 150 and the crank yoke 206 relative to the torpedo plug 160. The lower bearing 214 includes a lower fitting 234 and a shaft extension 236 that supports the crank yoke 206 on the lower fitting 234. The lower fitting 234 includes a stem portion 238 that is at least partially threaded and extends through the radial hole 180 in the bottom side of the torpedo plug 160 to engage a bore 240 formed in the bottom of the torpedo housing 52. In the illustrated embodiment, the stem portion 238 is threadedly engaged with the radial hole 180 in the torpedo plug 160 but not the bore 240 in the torpedo housing 52. Other embodiments, however, may be differently configured. Similarly to the upper fitting 218, the lower fitting 234 extends into and engages both the torpedo plug 160 and the torpedo housing 52 to retain the torpedo plug 160 in place relative to the torpedo housing 52. The shaft extension 236 has an upper portion 242 that is connected to the crank yoke 206 and a lower portion 246 that is rotatably received in a bore 248 in the lower fitting 234 such that the connected shift shaft 150 and the shaft extension 236 can rotate relative to the lower fitting 234.

Figure 21A:
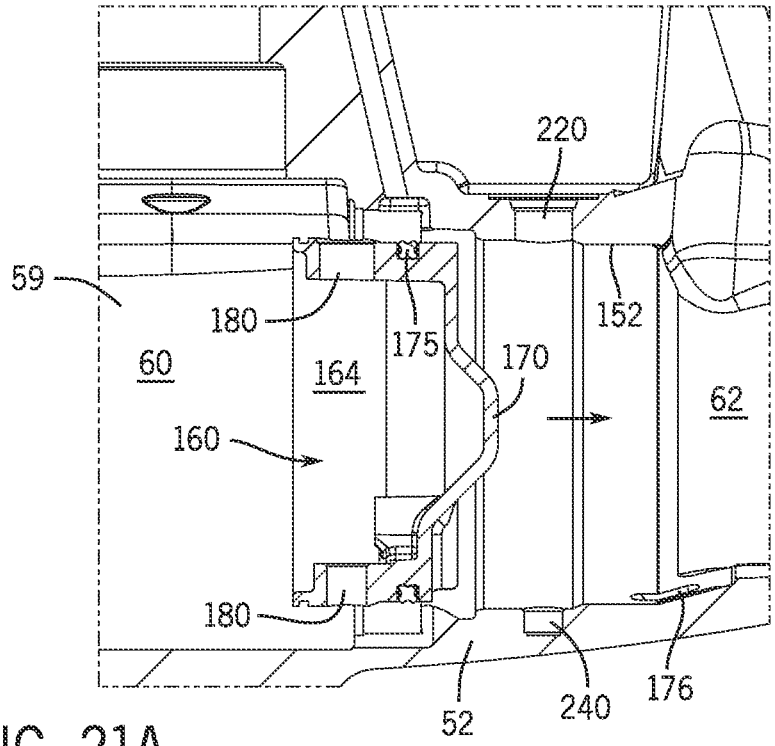
FIGS. 21A-21G are views of detailed section 14-14, taken in FIG. 2, illustrating the installation of the shift actuator and torpedo plug.
Figure 21B:
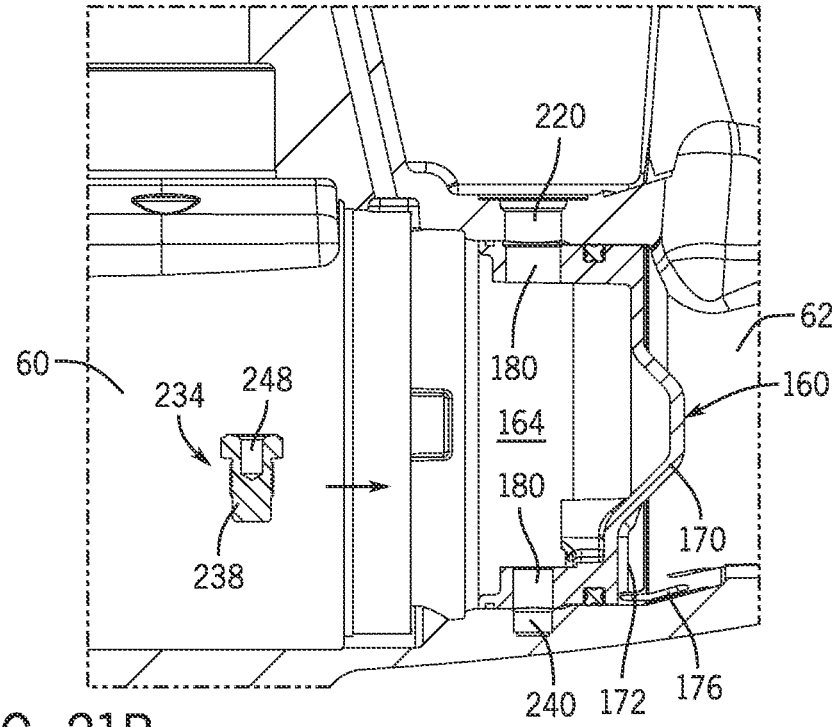
Figure 21C:
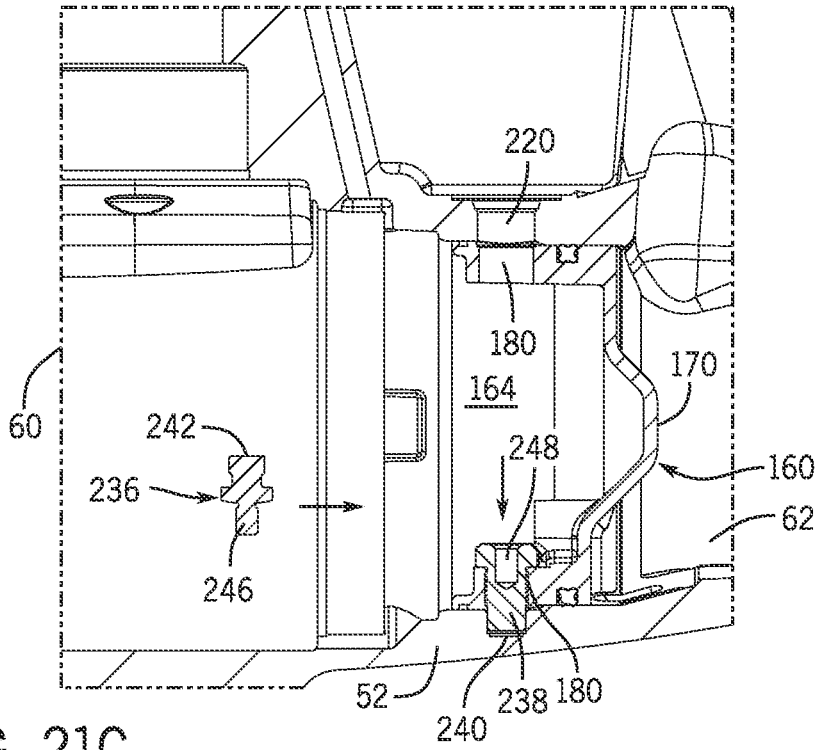

Referring to FIGS. 21A-21G, the torpedo plug 160 and the shift actuator 98 may be assembled in the torpedo housing 52 from the rear side thereof. First, as illustrated in FIG. 21A, the torpedo plug 160 is inserted into the gearcase compartment 59 via the back end of the torpedo housing 52. The torpedo plug slides towards the front of the torpedo housing 52 until the annular side wall 164 of the torpedo plug 160 abuts the inner wall 152 of the torpedo housing 52 and the radial holes 180 in the annular side wall 164 are aligned with the bores 220, 240 formed in the top and bottom of the torpedo housing 52, as illustrated in FIG. 21B. Once the torpedo plug 160 is in place, the lower fitting 234 is inserted into and engaged with the radial hole 180 and the bore 240 formed in the bottom sides of the torpedo plug 160 and torpedo housing 52, as illustrated in FIG. 21B, before the lower portion 246 shaft extension 236 is placed in the bore 248 in the lower fitting 234 as illustrated in FIG. 21C.

Figure 21D:
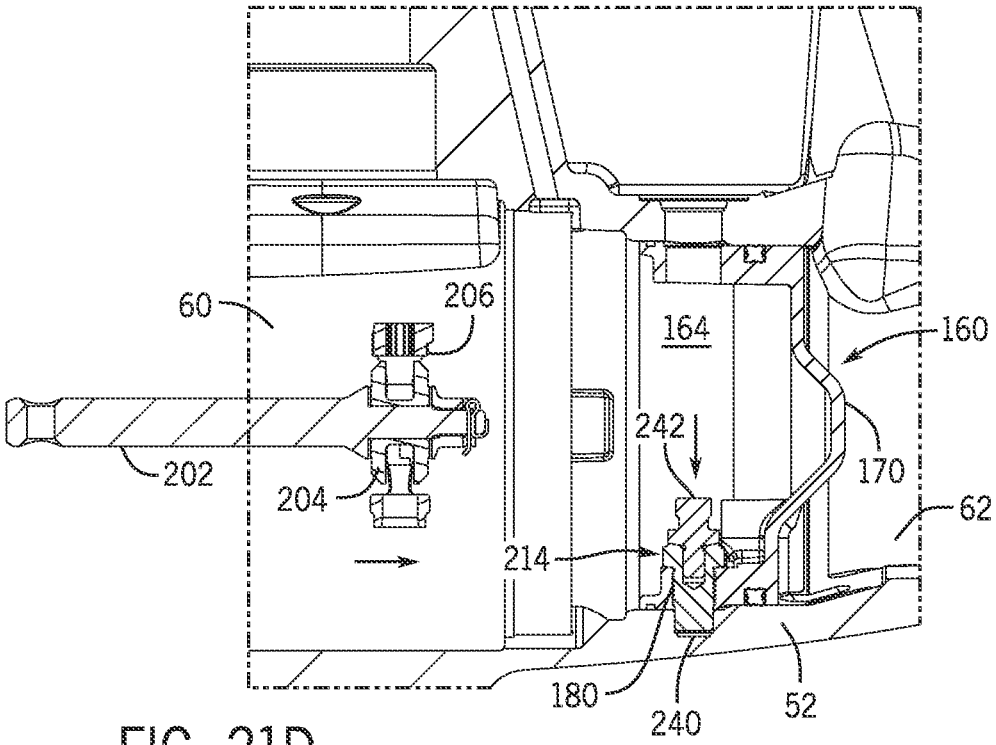
Figure 21E:
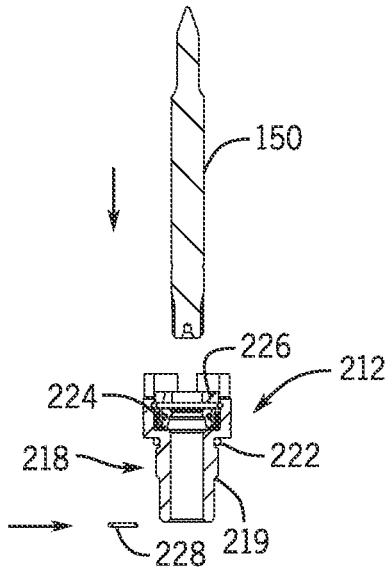
Figure 21F:
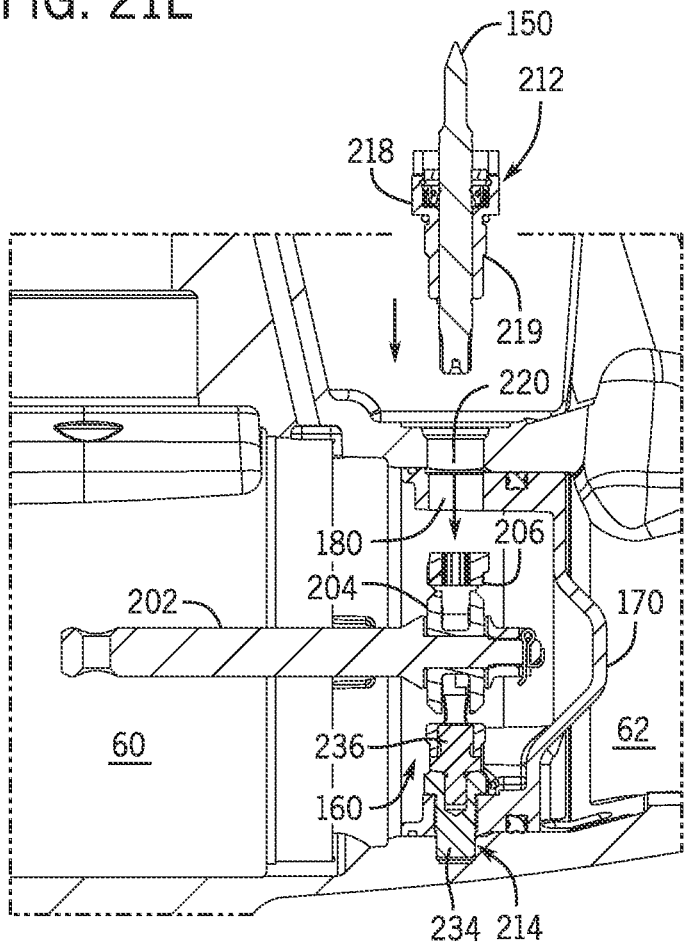
Figure 21G:
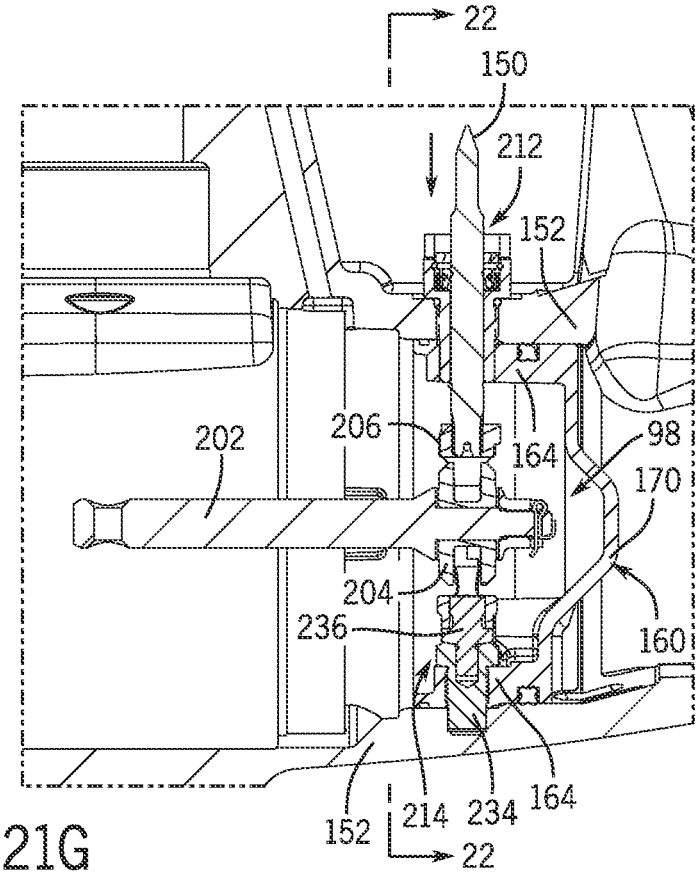
Figure 22:
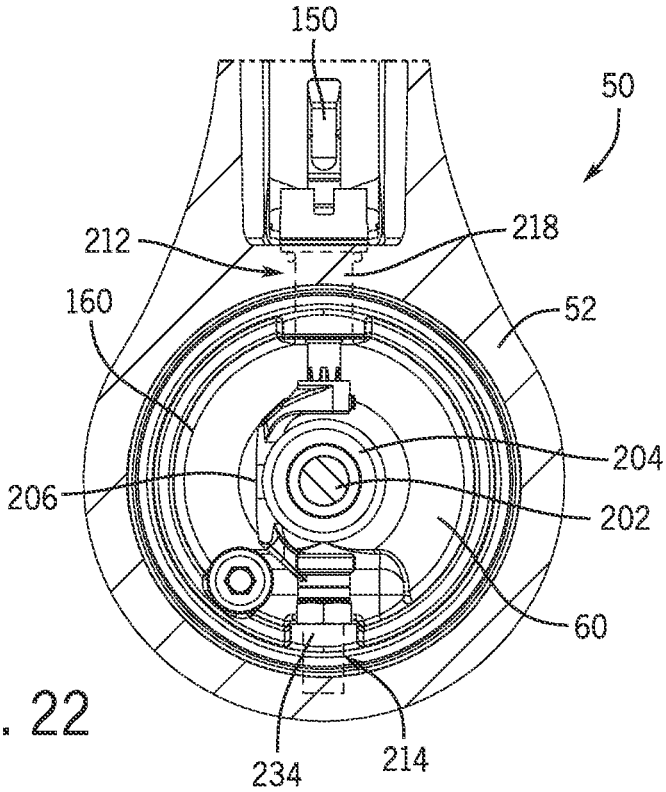
FIG. 22 is view of section 22-22, taken in FIG. 21G.

Referring to FIG. 21D, once the lower bearing 214 is positioned in the lubricant cavity 60, a subassembly of the actuator shaft 202, the crank collar 204, and the crank yoke 206 is inserted into the lubricant cavity 60 via the back end of the torpedo housing 52. The subassembly is then lowered onto the lower bearing 214 so that the shaft extension 236 engages the bottom of the crank yoke 206. As illustrated in FIGS. 21E-21G, the upper bearing 212 and the shift shaft 150 are then inserted into the lubricant cavity 60 through the bore 220 in the top of the torpedo housing 52 and the radial hole 180 in the top of the torpedo plug 160. In the illustrated embodiments, the shift shaft 150 is first inserted into and coupled to the upper bearing 212 before the upper bearing 212 is engaged with the torpedo housing 52 and the torpedo plug 160. Some embodiments, however, may be configured such that the upper bearing 212 is inserted through the bore 220 in the top of the torpedo housing 52 and the radial hole 180 in the top of the torpedo plug 160 before the shift shaft 150 is passed through the upper bearing 212. FIGS. 21G and 22 illustrate the assembled shift actuator 98 and torpedo plug 160 in the gearcase assembly 50.

Once assembled, the upper bearing 212 and the lower bearing 214 extend through the annular side wall 164 of the torpedo plug 160 such that, together with the shift shaft 150, the upper bearing 212 and the lower bearing 214 retain the torpedo plug 160 in place relative to the torpedo housing 52. Advantageously, fixing the position of the torpedo plug 160 with the shift actuator 98 secures the torpedo plug 160 in the desired position without the use of additional fasteners. Use of the shift actuator 98 to secure the novel torpedo plug 160 advantageously requires less space within the lubricant cavity 60, thereby providing additional space in the water cavity 62 for the lower water inlets 176 formed proximate the bottom of the torpedo housing 52. The efficient use of space also provides additional space for the beveled gearset 72 (FIG. 2), which allows for the use of gears with smaller pitch angles and lower gear ratios.

Embodiments of a marine drive including a gearcase with lubricant contained in a lubricant cavity may occasionally need to have the lubricant drained from the cavity so that new lubricant can be added as part of the normal maintenance of a marine drive. To drain and/or fill the lubricant cavity, a gearcase may include a drain port. During research and development in the field of marine drives, the present inventors determined that the process of draining the lubricant cavity can be a time-consuming process as the generally viscous lubricant must flow out from relatively small apertures. Further, the geometry of some lubricant cavities may prevent the cavity from completely draining in a single position and the gearcase will need to be moved into multiple orientations to completely drain the lubricant cavity. Through their research and experimentation, the present inventors determined that it would be advantageous to provide a gearcase with a system for quickly filling or draining lubricant from a lubricant cavity via a single port.

Referring to FIGS. 23-30, embodiments of a gearcase assembly 50 may be configured for use with a novel combination filling/draining device 310 having multiple different configurations for filling, draining, and sealing the lubricant cavity 60. The combination filling/draining device 310 is removably received in a passage 316 formed through the body of the torpedo housing 52 and includes a fitting 312 and a plug 314 configured to be nested in the fitting 312.

Figure 27:
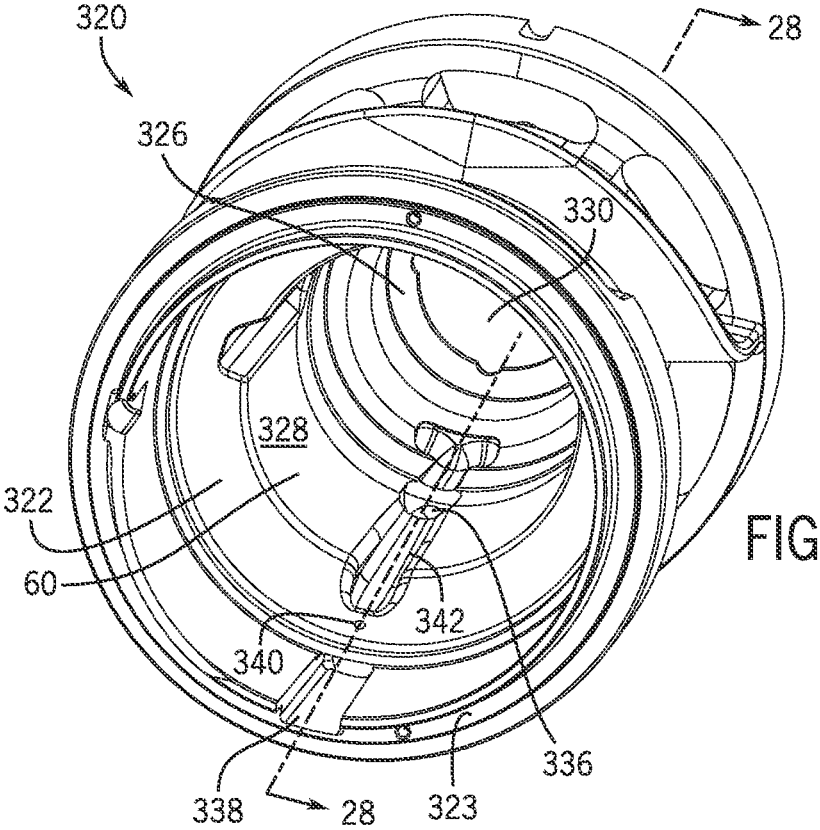
FIG. 27 is a perspective view of the rear body portion of the torpedo housing of FIG. 26.
Figure 28:
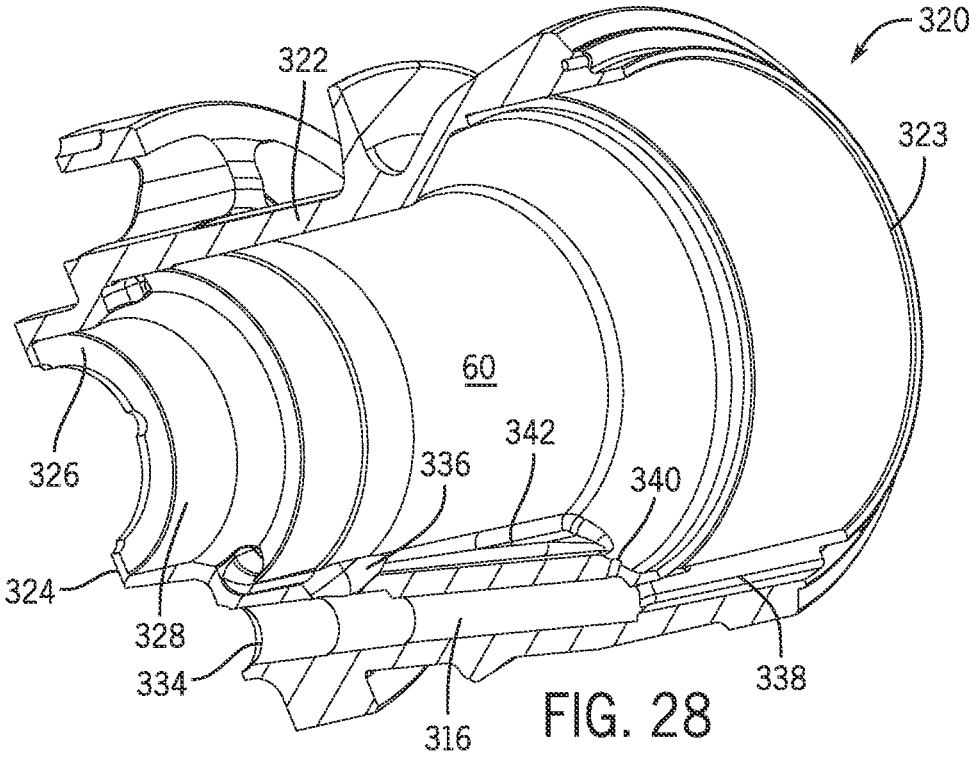
FIG. 28 is a perspective view of section 28-28, taken in FIG. 27.

FIGS. 27 and 28 illustrate a rear body portion 320 that forms a rear portion of the torpedo housing 52 and encloses a portion of the lubricant cavity 60. The illustrated rear body portion 320 is a cast metal component. Some embodiments, however, may be formed from another material. The rear body portion 320 is generally cylindrical and includes an annular side wall 322 extending from a front end 323 to a back end 324. The back end of the rear body portion 320 includes an annular rim 326 extending radially inward from radially inner surface 328 of the annular side wall 322 to define a central opening 330. The output shaft 64 is configured to extend out from the torpedo housing 52 through the central opening 330. At least one annular dynamic seal 332 (FIG. 31) forms a seal between the output shaft 64 and the central opening 330 to prevent the ingress of water into the lubrication cavity 60 of the gearcase assembly 50. As illustrated in FIG. 2, the front end 323 of the rear body portion 320 abuts and is sealed against a front body portion 318 of the torpedo housing 52, which includes a forward portion of the lubricant cavity 60. A seal 319 between the front body portion 318 and the rear body portion 320 is configured to prevent the ingress of water into the lubrication cavity 60

To facilitate the filling and draining of the lubricant cavity 60, the rear body portion 320 includes a passage 316 formed in the annular side wall 322 on the bottom side of the rear body portion 320. The passage 316 extends through the annular side wall 322 from an inlet 334 formed in the back end 324 of the rear body portion 320 towards the front end 323 thereof. The passage 316 is connected to the lubricant cavity 60 via a first bore 336 and a second bore 338 formed through the annular side wall 322. The first bore 336 is positioned proximate the back end 324 and the second bore 338 is located at the opposite side of the lubricant cavity 60 proximate the front end 323 such that the first bore 336 is closer to the inlet 334 than the second bore 338. In some embodiments, a channel 342 formed in the lower surface of the lubricant cavity 60 may be configured to funnel lubricant towards the first bore 336, which may be useful when draining lubricant from the lubricant cavity. The illustrated rear body portion 320 of the torpedo housing 52 additionally includes a third bore 340 extending through the annular side wall 322 between the first bore 336 and the second bore 338. Some embodiments, however, may omit the third bore and/or may include another bore in a different location. Each of the bores 336, 338, 340 is configured to convey lubricant between the lubricant cavity 60 and the passage 316.

Figure 23:
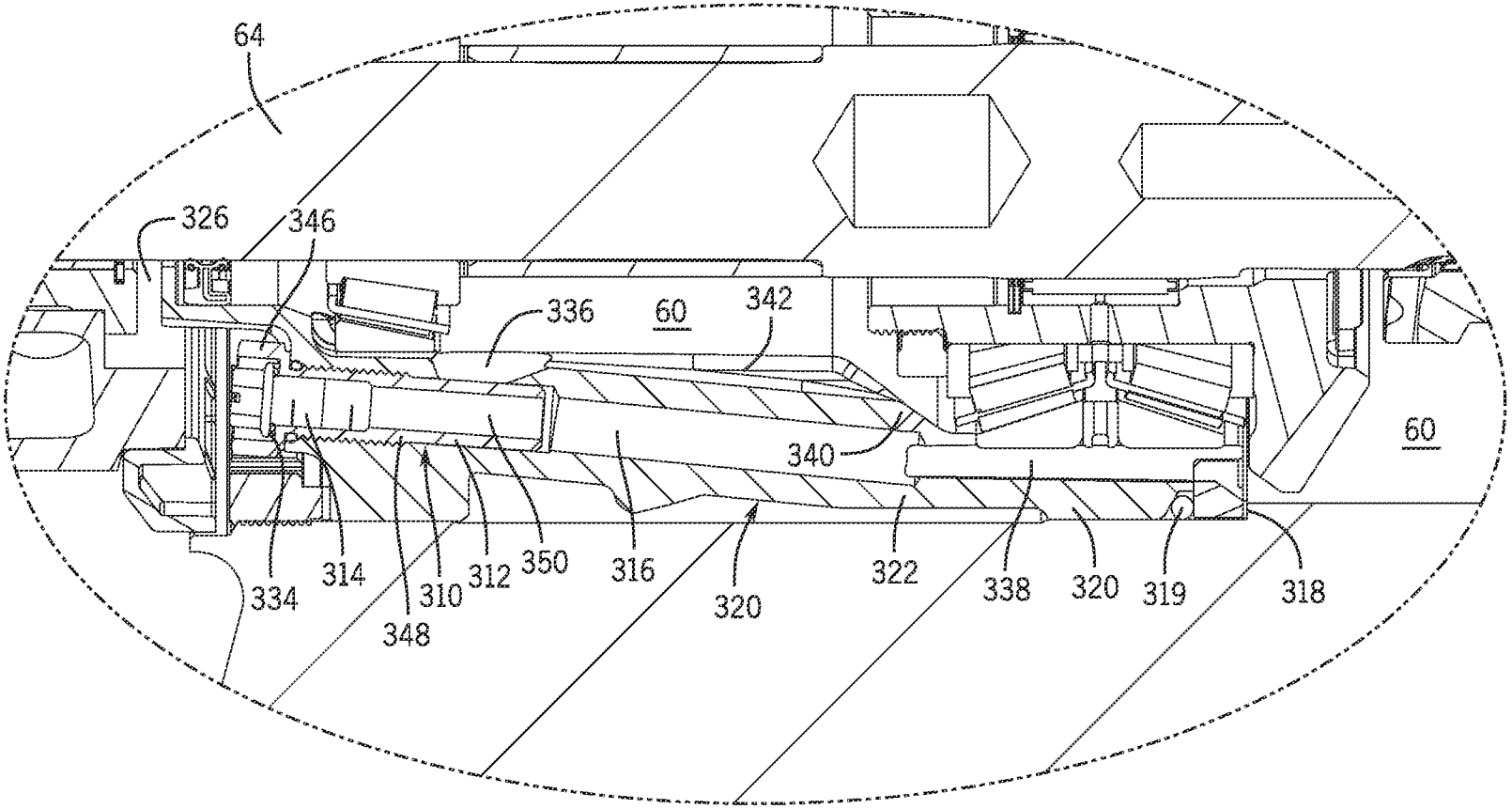
FIG. 23 is a view of detailed section 23-23, taken in FIG. 2, including a combination filling/draining device in the closed configuration.
Figure 24:
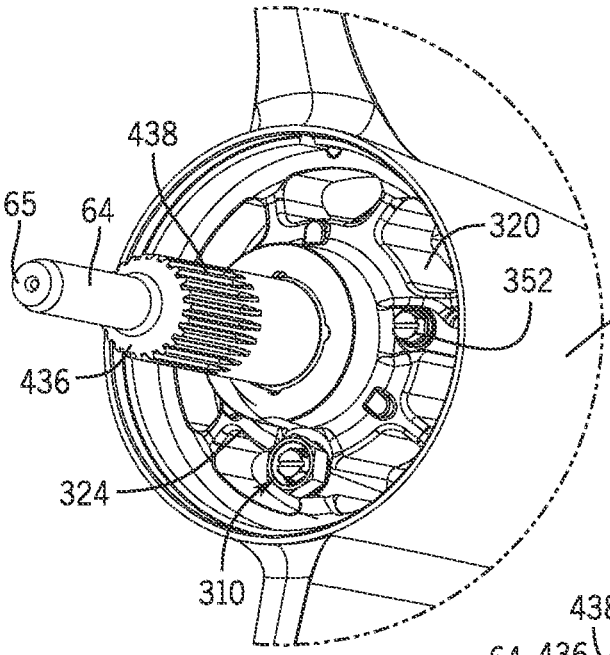
FIG. 24 is a partial perspective view of a gearcase including a combination filling/draining device in the closed configuration.
Figure 25:
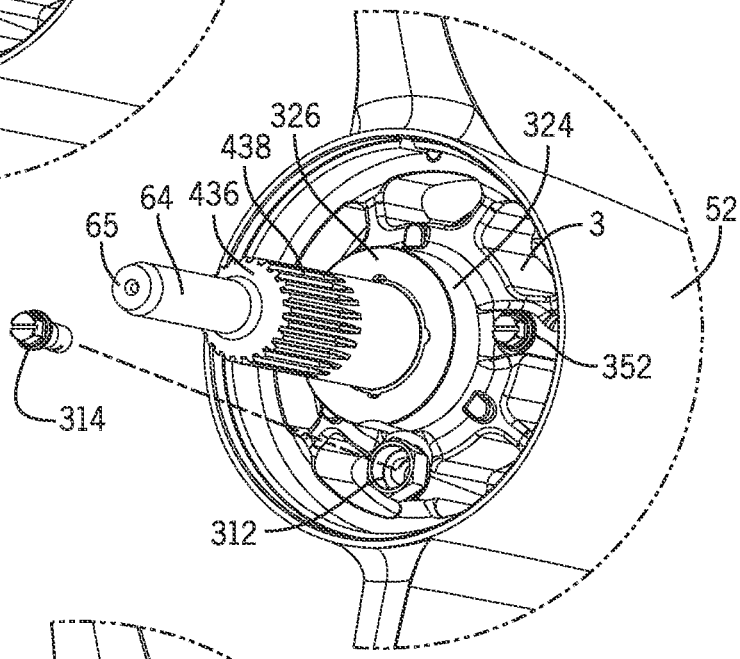
FIG. 25 is the partial perspective view of FIG. 24, with the combination filling/draining device in the filling configuration.
Figure 26:
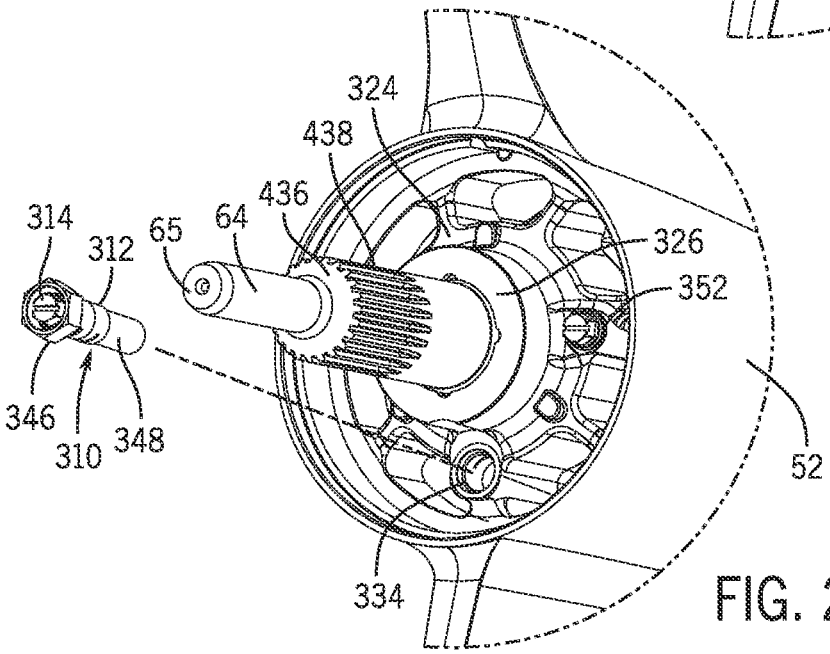
FIG. 26 is the partial perspective view of FIG. 25, with the combination filling/draining device in the draining configuration.

Referring to FIGS. 23-26, the combination filling/draining device 310 is configured to be received in the passage 316 via the inlet 334. The combination filling/draining device 310 includes a fitting 312 with a head 346 and a stem 348 extending from the head 346. The fitting 312 includes a through-bore 350 that extends axially through the fitting 312 from the head 346 to the end of the stem 348. The through-bore 350 facilitates filling of the lubricant cavity via the passage 316. A plug 314 is configured to be received in the through-bore 350 and coupled to the stem 348 by a fastener portion of the plug 314. In this configuration, the plug 314 seals the through-bore 350, thereby preventing the inflow and outflow of lubricant via the through-bore 350. As illustrated in FIGS. 24-26, the back end of the rear body portion 320 includes a vent plug 352 that may be loosened or removed to provide a pathway for air to leave or enter the lubricant cavity 60 as it is displaced as the lubricant is respectively pumped into or drained from the lubricant cavity 60.

As previously mentioned, the combination filling/draining device 310 has different configurations for sealing, filling, and draining lubricant from the lubricant cavity 60. In particular, the filling/draining device has a filling configuration for filling lubricant into the lubricant cavity 60, a draining configuration for draining lubricant from the lubricant cavity 60, and a closed configuration in which inflow and outflow of lubricant from the lubricant cavity 60 is restricted.

FIGS. 23 and 24 illustrate the combination filling/draining device 310 in a closed configuration in which outflow of the lubricant from the lubricant cavity 60 via the passage 316 is prevented. In the closed configuration, the stem 348 of the fitting is fully inserted in the passage 316 via the inlet 334 such that the stem 348 blocks the first bore 336, thereby preventing lubricant from flowing into the passage 316 via the first bore 336. In the closed configuration, the plug 314 is positioned in the through-bore 350 through the fitting 312, thereby preventing lubricant from flowing out of the passage 316 through the through-bore 350. Thus, outflow of the lubricant from the lubricant cavity 60 via the passage is prevented when the combination filling/draining device 310 is in the closed configuration.

Figure 29:
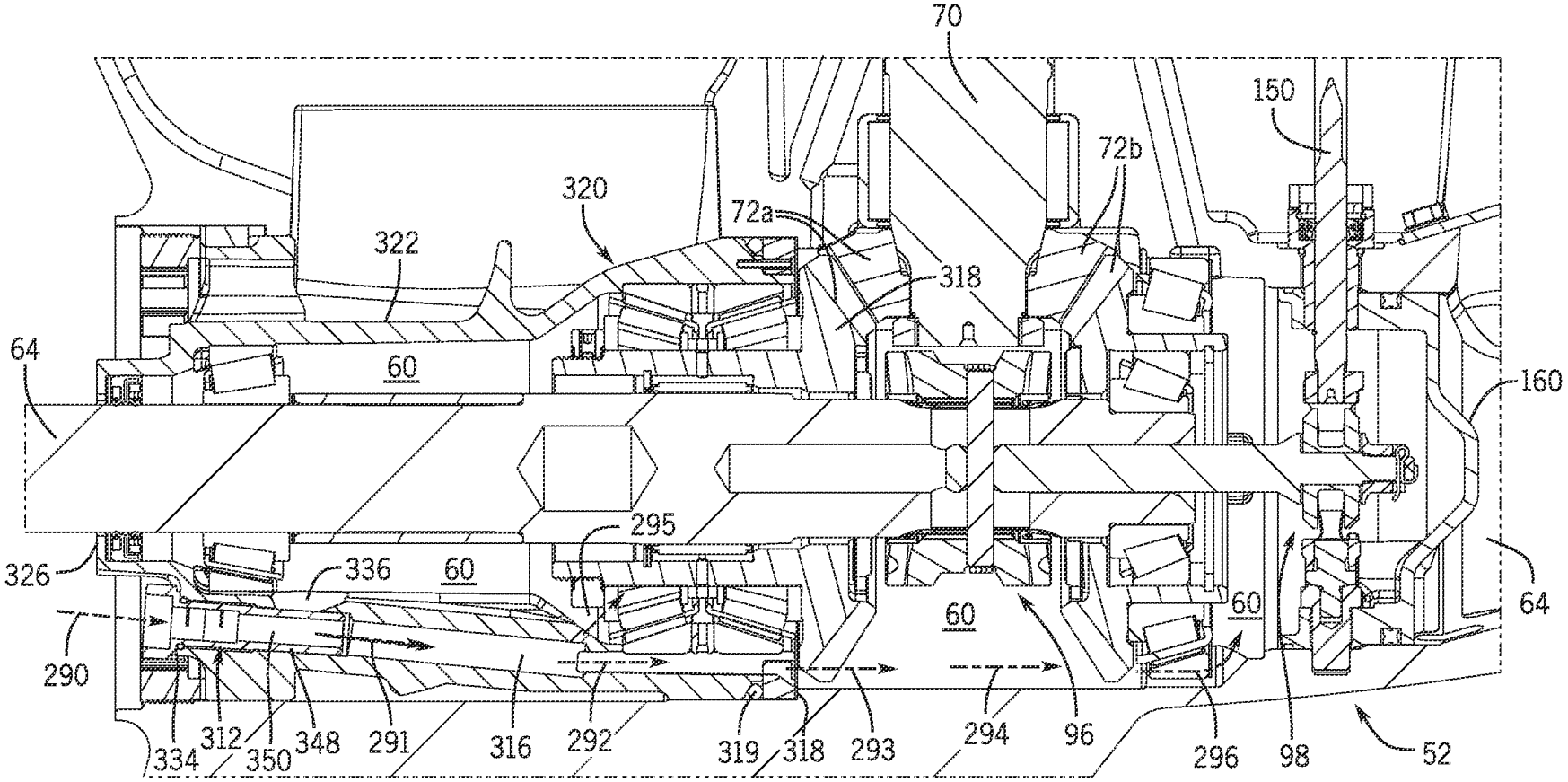
FIG. 29 is a view of section 23-23, taken in FIG. 2, including a combination filling/draining device in the filling configuration

FIGS. 25 and 29 illustrate the combination filling/draining device 310 in a filling configuration in which inflow of the lubricant to the lubricant cavity 60 via passage 316 is permitted. In the filling configuration, the fitting 312 is disposed in the passage 316 and the plug 314 is removed from the through-bore 350 of the fitting 312. In this configuration, the stem 348 of the fitting 312 blocks the first bore 336, thereby preventing the inflow of the lubricant to the lubricant cavity 60 via the first bore 336. This may be useful, for example, to ensure that lubricant is convey to and fills the forward portions of the lubricant cavity 60. If lubricant was permitted to flow into the lubricant cavity 60 via the first bore 336, lubricant may accumulate in the rear portions of the lubricant cavity 60 without flowing to and completely filling the forward portions thereof, which would result in an improperly filled lubricant cavity 60. Lubricant is permitted to flow into the lubricant cavity via the second bore 338 and the third bore 340 by following the flow path generally indicated by arrows 290-296. Because the second and third bores 338, 340 are located proximate an opposite end of the lubricant cavity 60, the lubricant will flow back towards the rear portions of the lubricant cavity 60 as it is pumped in via the passage 316, ensuring proper lubricant levels in the lubricant cavity 60.

Although not show, the vent plug 352 may be either loosened or removed when the combination filling/draining device 310 is in the filling configuration. This may be useful to allow air to escape the lubricant cavity 60 as the lubricant cavity 60 is filled. In some embodiments, the location of the vent plug 352 may be selected so that lubricant will flow out of the lubricant cavity 60 when the proper lubricant level in the cavity 316 has been reached.

Figure 30:
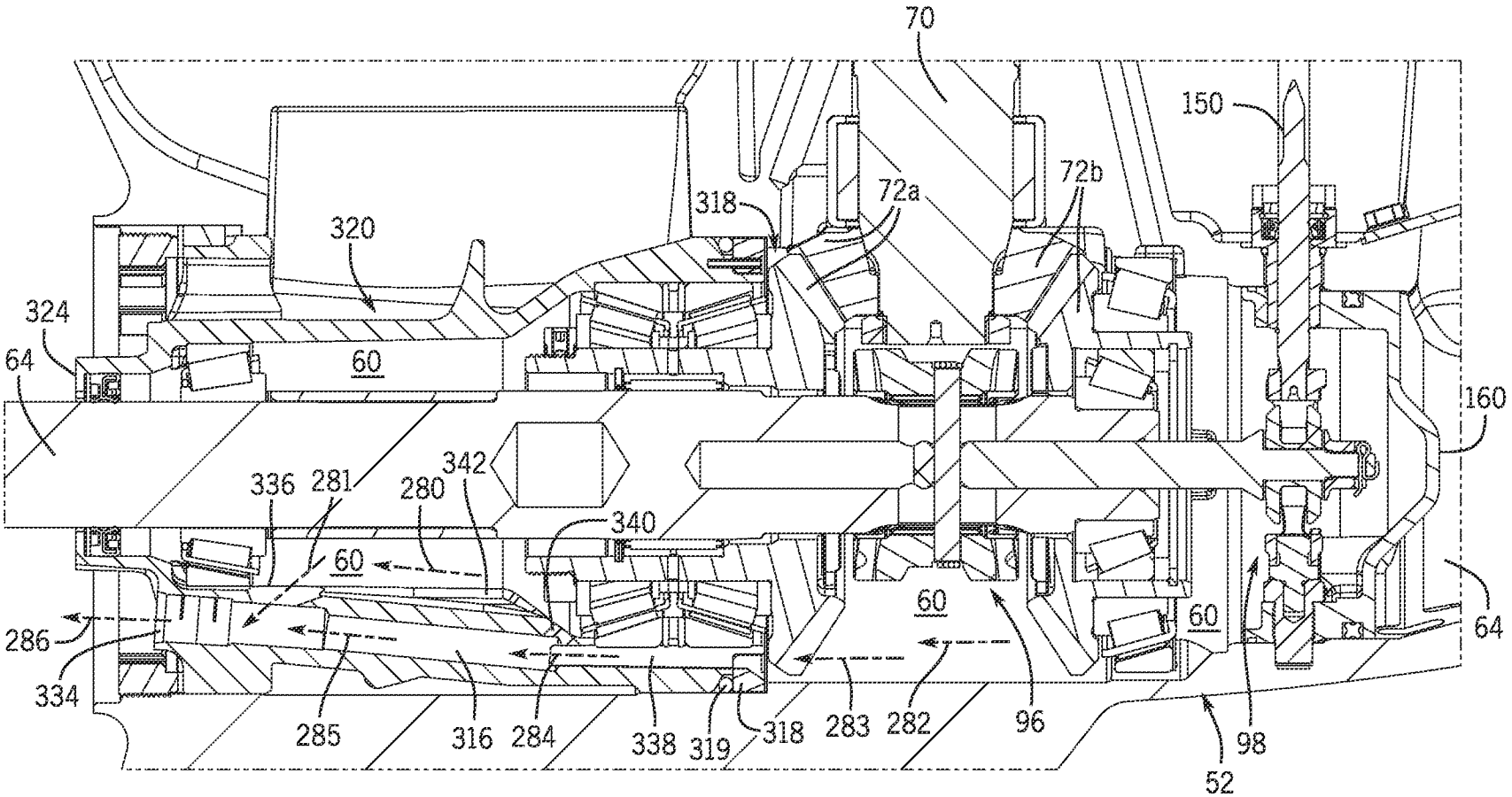
FIG. 30 is a view of detailed section 23-23, taken in FIG. 2, including a combination filling/draining device in the draining configuration.

FIGS. 26 and 30 illustrate the combination filling/draining device 310 in a draining configuration in which outflow of the lubricant from the lubricant cavity 60 via the first bore 336 is comparatively less restricted. In the draining configuration, both the fitting 312 and the plug 314 are removed from the passage 316 so that lubricant may freely flow therethrough. With the fitting 312 removed, the first bore 336 is unobstructed, thereby permitting the outflow of the lubricant from the lubricant cavity 60 via the first bore 336 in addition to through the second bore 338. While lubricant is permitted to flow through the third bore 340, the small diameter of the third bore 340 restricts the flow of lubricant therethrough. Lubricant primarily flows out of the forward portions of the lubricant cavity 60 and into the passage 316 via the second bore 338 following the flow path generally indicated by arrows 282-284. Lubricant primarily flows out of the rear portions of the lubricant cavity 60 and into the passage 316 via the first bore 336 following the flow path generally indicated by arrows 280 and 281. The channel(s) 342 formed in the bottom of the lubricant cavity 60 may advantageously guide lubricant towards the first bore 336. Once lubricant reaches the passage 316, it can flow out of the gearcase assembly 50 via the inlet 334 by following the flow path generally indicated by arrows 285 and 286.

When the combination filling/draining device 310 is in the draining configuration and the torpedo housing 52 is tilted so that the passage 316 is generally horizontal, the lubricant within the lubricant cavity is funneled towards either the first bore 336 or the second bore 338 such that substantially the entire lubricant cavity 60 may be drained without moving the torpedo housing 52. Advantageously, the inclusion of two large bores 336, 338 between the lubricant cavity 60 and the passage 316 significantly reduces the time required to drain the lubricant cavity 60, thereby reducing the required time for maintenance. Although not show, the vent plug 352 may be either loosened or removed when the combination filling/draining device 310 is in the draining configuration. This may be useful to allow air to enter the lubricant cavity 60 via the vent plug opening to prevent a negative gauge pressure from forming in the lubricant cavity 60, which would restrict the flow rate of lubricant out of the lubricant cavity 60.

Figure 31:
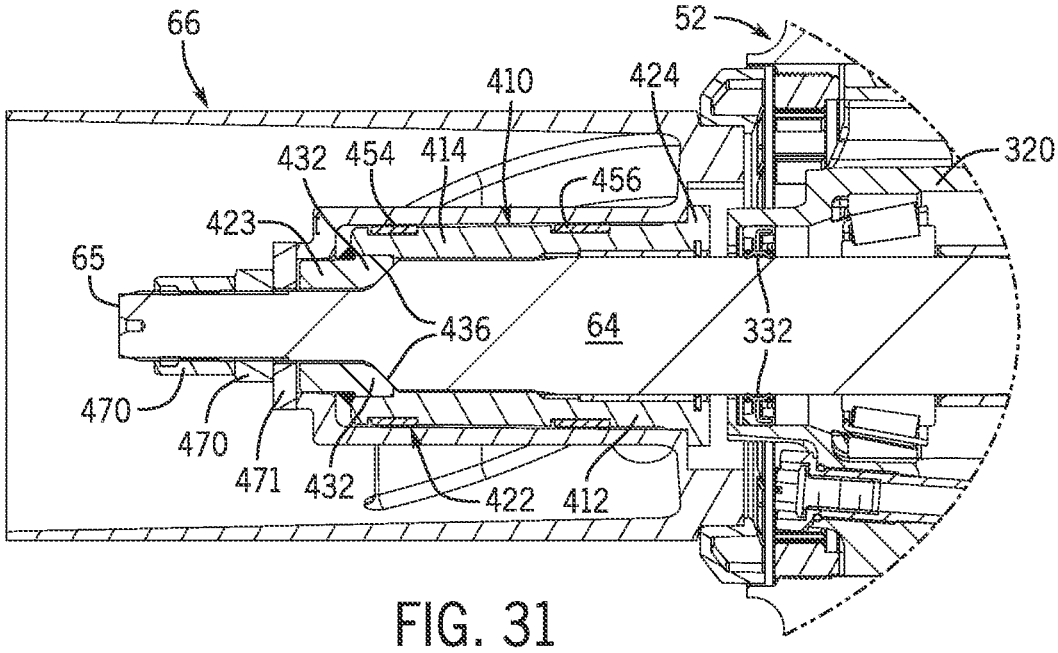
FIG. 31 is view of section 31-31, taken in FIG. 2.
Figure 32:
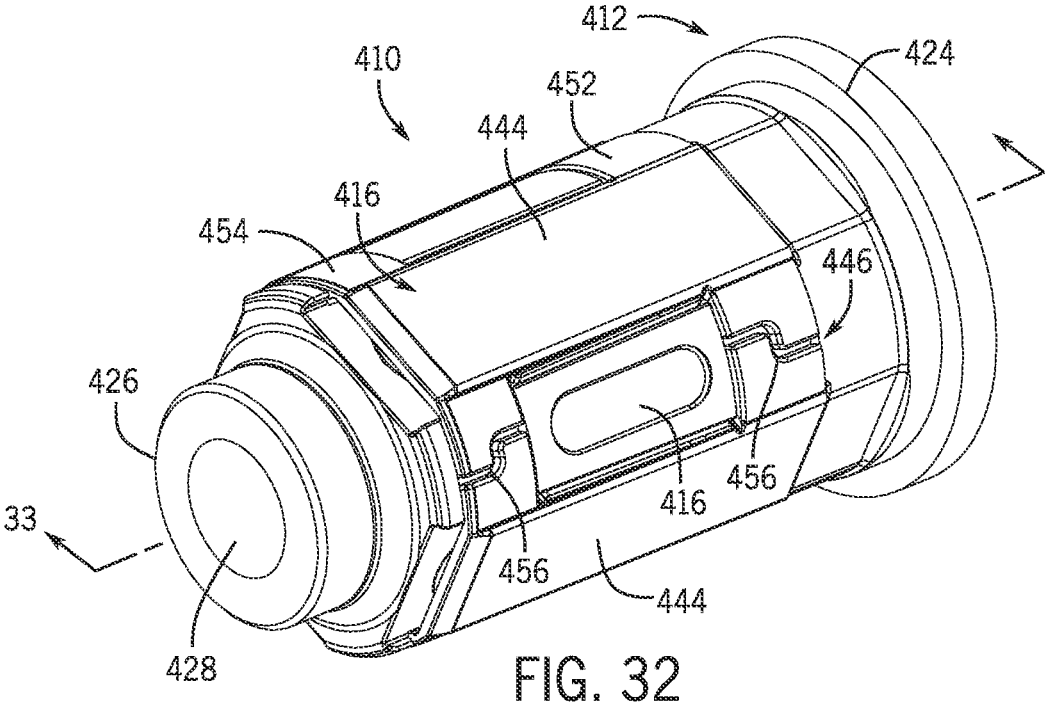
FIG. 32 is a perspective view of the adapter assembly from the gearcase of FIG. 31.

As illustrated in FIGS. 1 and 2, embodiments of the gearcase assembly 50 may be configured for use with a propulsor 66 that is mounted on the output shaft 64. While some propulsors can be directly coupled to the output shaft 64, some embodiments include an adapter for connecting the propulsor 66 to the output shaft. For example, FIGS. 31 and 32 illustrate an embodiment of an adapter assembly 410 for coupling a propulsor 66 to the output shaft 64 (i.e., a propulsor shaft). The adapter assembly 410 includes an adapter 412 with a stem 414 configured to support the propulsor 66, a wear resistant snubber 416 on the stem, and at least one elastomeric member 418 (FIG. 35) which is sandwiched between the snubber 416 and the stem 414.

Figure 33:
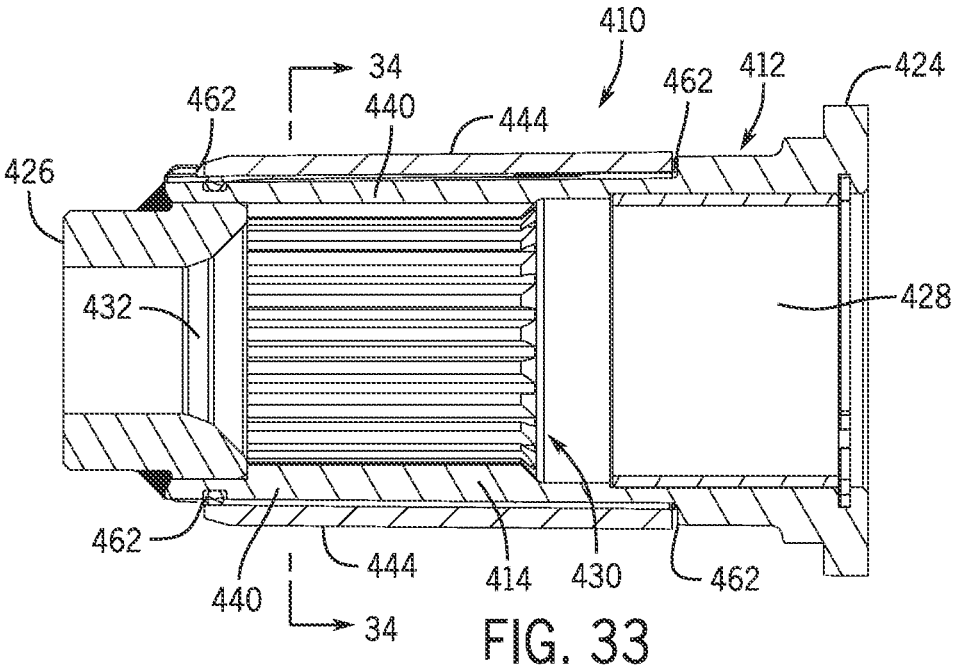
FIG. 33 is a view of section 33-33, taken in FIG. 32.
Figure 34:
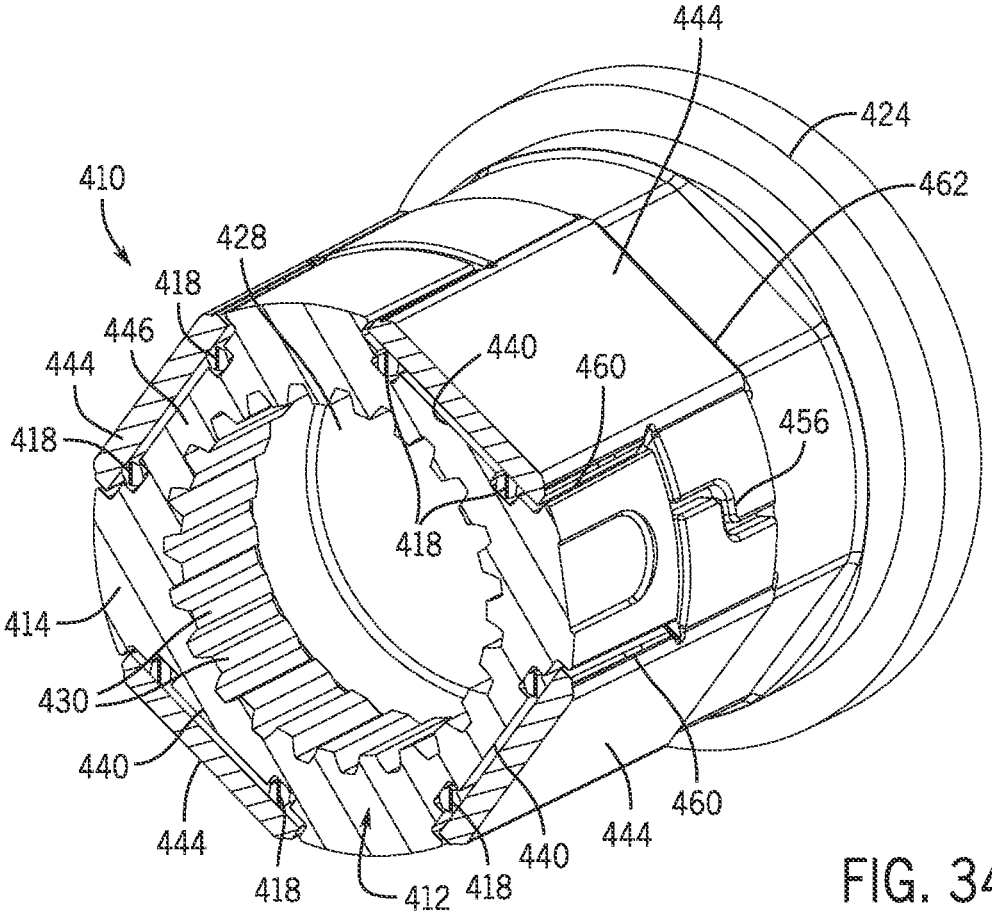
FIG. 34 is a view of section 34-34, taken in FIG. 33.
Figure 35:
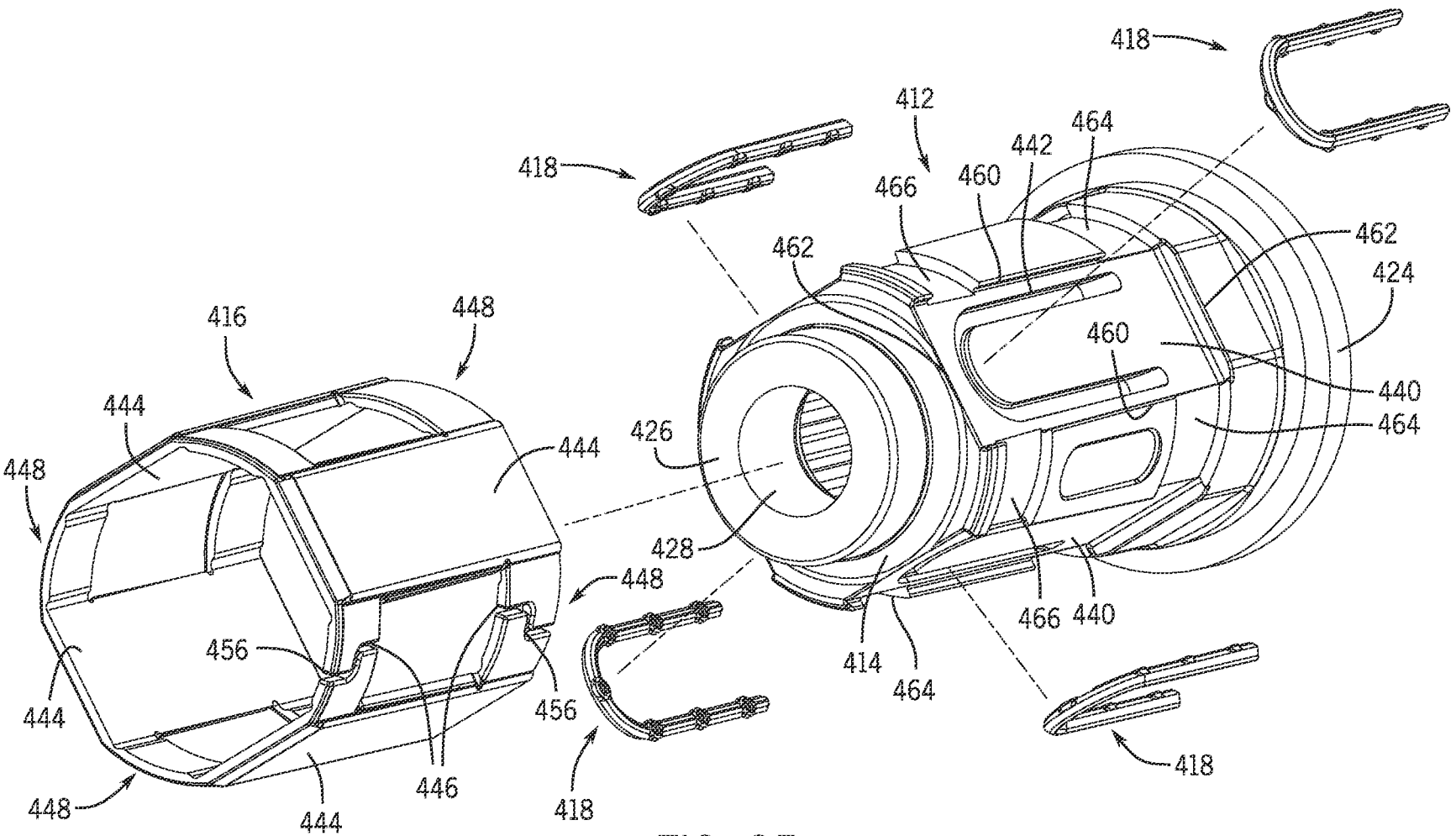
FIG. 35 is an exploded perspective view of the adapter assembly of FIG. 34.

Referring to FIGS. 33-35 the stem 414 of the adapter 412 extends from a flange 424 to an opposite distal end 426 of the adapter 412. A through-bore 428 extends axially through the adapter 412 from the flange 424 to the distal end 426 thereof. The radially inner surface of the through-bore 428 includes a plurality of axially extending splines 430 and a beveled inner abutment surface 432 proximate the distal end 426 of the stem 414. As illustrated in FIG. 31, the output shaft 64 extends through the through-bore 428 and includes a distal end 65 that projects out from the distal end 426 of the stem 414. The output shaft 64 includes a beveled outer abutment surface 436 that engages the beveled inner abutment surface 432 of the adapter 412 so as to prevent inward axial movement of the adapter 412 on the output shaft 64. A plurality of splines 438 (FIGS. 24-26) on the output shaft 64 engage the corresponding spline 430 on the adapter 412 so that the adapter assembly 410 rotates with the output shaft 64.

Figure 36:
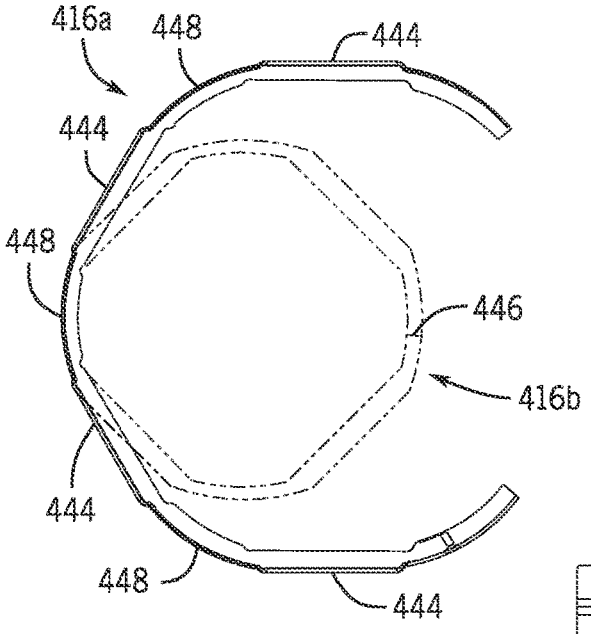
FIG. 36 is an axial view of the wear resistant snubber from the adaptor assembly of FIG. 35.
Figure 37:
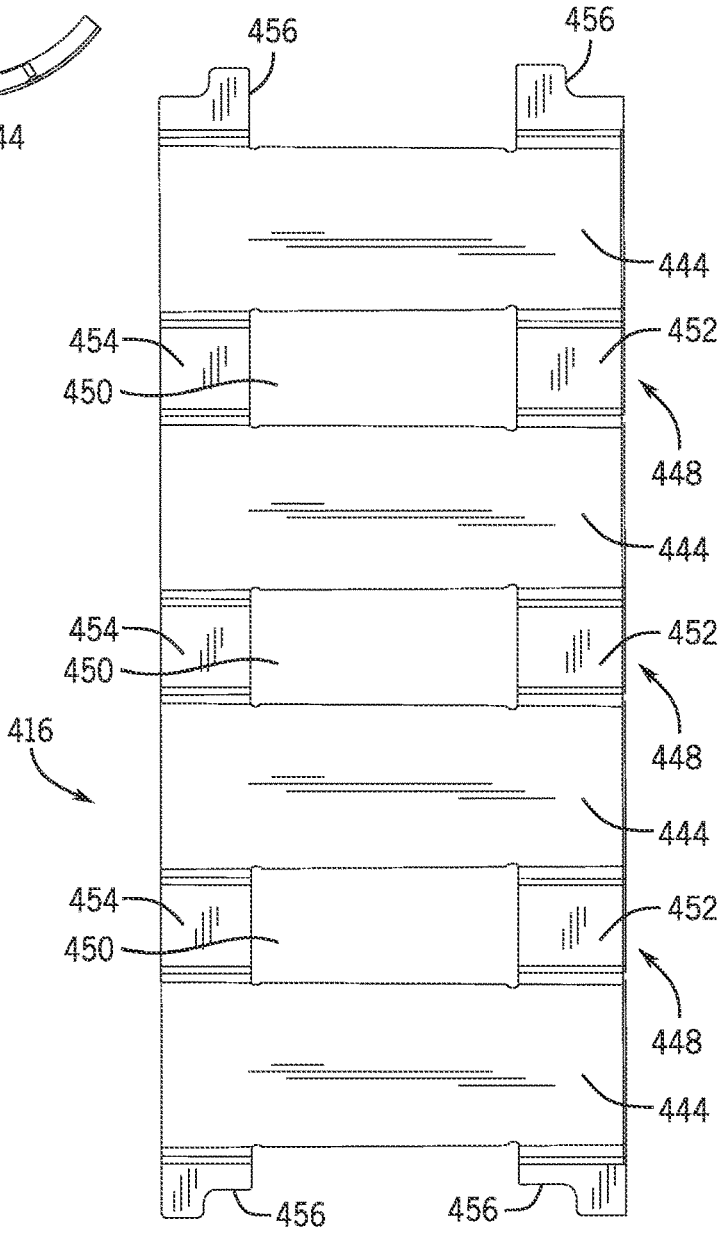
FIG. 37 is a layout view of the wear resistant snubber of FIG. 36.

Referring to FIGS. 36 and 37, the illustrated snubber 416 is configured as a monolithic, annular member configured to wrap around the stem 414 of the adapter 412. The annular shape of the snubber is broken at a split line 446 such that the snubber 416 can be widened to be installed on the stem 414. For example, in FIG. 36, the original annular shape of the snubber **416*b* is depicted in dashed lines and the snubber 416*a* in a widened, expanded state is depicted in solid lines. The snubber 416 is formed from a resiliently deformable material that is configured to retain its annular shape such that, after the snubber 416 is widened for installation on the adapter 412, the monolithic annular member springs back to the original annular shape, thereby securing the snubber 416 on the stem 414**.

As illustrated in FIG. 37, the snubber 416 includes a plurality of generally planar panels 444. Each panel 444 is separated from the adjacent panels 444 by a connecting segment 448. The connecting segments 448 each include a slot 450 with opposing circumferential strips 452, 454 positioned on opposite axial ends of the slots 450. The split line 446 is located at one of the connecting segments 448 and axially extends along the circumferential strips 452, 454. The split line 446 includes a radial jog 456 that divides each circumferential strips 452, 454 to create an interlocking pattern at the split line 446.

Referring to FIGS. 32-35, the outer surface of the stem 414 includes a plurality of outer flats 440 spaced evenly around the outer surface of the stem 414. Each outer flat 440 includes an elongated channel 442 configured to receive a corresponding elastomeric member 418. The illustrated elastomeric members 418 and the corresponding channels 442 have an elongated U-shape. Some embodiments, however, may include at least one differently shaped elastomeric member 418 and corresponding channel 442. Each outer flat 440 on the stem 414 corresponds to a panel 444 on the snubber 416. When the snubber 416 is installed on the stem 414, each panel 444 is positioned on a corresponding flat 440 such that the elastomeric members 418 and sandwiched between an outer flat 440 and a snubber panel 444. In the illustrated embodiment, the adapter 412 includes four outer flats 440 spaced evenly around the stem 414 and the snubber correspondingly includes four panels 444. Some embodiments, however, may have a different number of corresponding outer flats and snubber panels.

The outer flats 440 are recessed into the exterior surface of the stem 414 such that each panel 444 is retained in position thereon. Opposing side walls 460 extend axially along opposite sides of each outer flat 440 and are configured to retain the corresponding panel 444 in circumferential alignment with the outer flat 440. Similarly, opposing end walls 462 are positioned at opposite axial ends of each outer flat 440 and are configured to retain the panel 444 in axial alignment with the corresponding outer flat 440. Circumferential slots 464, 466 extend around the outer surface of the stem 414 proximate the flange 424 and the distal end 426 of the stem 414. The circumferential slots 464, 466 are each configured to receive one of the circumferential strips 452, 454 of the snubber 416 The circumferential slots 464 and corresponding circumferential strips 452 positioned proximate the flange 424 are differently sized that the corresponding circumferential slots 466 and strip 454 proximate the distal end 426 of the stem. This may be useful, for example, to ensure that the snubber 416 is installed on the adapter 412 in the correct orientation.

Referring to FIG. 31, the propulsor 66 includes a propulsor hub 422 dimensioned to receive the adapter assembly 410 positioned on the output shaft 64. When assembled, the distal end 65 of the output shaft 64 project out from an axial opening 423 at the end of the propulsor hub 422. At least one fastener 470 and a washer 471 may be secured on the distal end 65 of the output shaft 64 to secure the propulsor on the output shaft 64 and the adapter assembly 410. The radially inner surface of the propulsor hub 422 includes inner flats (not shown) that correspond to and abut the panels 444 on the outer flats 440. Engagement between the propulsor hub 422 and the adapter assembly rotationally fixes the propulsor 66 relative to the output shaft 64 such that the propulsor rotates with the output shaft 64. The elastomeric members 418 (FIG. 35) bias the panels 444 (FIG. 35) radially outward and into engagement with the inner flats of the propulsor hub 422, thereby creating a tight friction fit between the propulsor hub 422 and the adapter assembly 410. This may be useful, for example, to prevent the propulsor from rattling or vibrating when rotated by the output shaft 64.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. An assembly for coupling a propulsor to a propulsor shaft of a marine drive, the assembly comprising:

an adapter having a stem for supporting the propulsor, a wear resistant snubber on the stem, and an elastomeric member sandwiched between the wear resistant snubber and the stem, the elastomeric member being configured to bias the wear resistant snubber radially outwardly into engagement with the propulsor.

2. The assembly according to claim 1, wherein the stem comprises an outer flat and wherein the wear resistant snubber comprises a panel on the outer flat, the panel being configured to abut an inner flat on the propulsor.

3. The assembly according to claim 2, wherein the elastomeric member is elongated and disposed in a corresponding elongated channel in the outer flat.

4. The assembly according to claim 3, wherein the elastomeric member has an elongated U-shape and wherein the corresponding elongated channel has an elongated U-shape.

5. The assembly according to claim 2, further comprising opposing side walls alongside the outer flat, the opposing side walls being configured to retain the panel in circumferential alignment on the stem, and opposing end walls alongside the outer flat, the opposing end walls being configured to retain the panel in axial alignment on the stem.

6. The assembly according to claim 2, further comprising opposing side walls alongside the outer flat, the opposing side walls being configured to retain the panel in circumferential alignment on the stem.

7. The assembly according to claim 2, further comprising opposing end walls alongside the outer flat, the opposing end walls being configured to retain the panel in axial alignment on the stem.

8. The assembly according to claim 1, wherein the stem comprises a plurality of outer flats and wherein the wear resistant snubber comprises a plurality of panels on the plurality of outer flats.

9. The assembly according to claim 8, wherein the elastomeric member is one of a plurality of elastomeric members sandwiched between the plurality of panels and plurality of outer flats.

10. The assembly according to claim 9, wherein each elastomeric member in the plurality of elastomeric members is elongated and disposed in a corresponding elongated channel in the stem.

11. The assembly according to claim 1, wherein the wear resistant snubber is wrapped around the stem.

12. The assembly according to claim 1, wherein the wear resistant snubber comprises a monolithic annular member.

13. The assembly according to claim 12, further comprising a split line in the monolithic annular member configured such that the monolithic annular member can be widened during installation on the stem.

14. The assembly according to claim 13, wherein the monolithic annular member tends to retain an original annular shape such that after the monolithic annular member is installed onto the stem and released, the monolithic annular member springs back to the original annular shape and thus is secured on the stem.

15. The assembly according to claim 13, wherein the split line axially extends along the monolithic annular member and comprises a circumferential jog.

16. A propulsor assembly for a marine drive, the propulsor assembly comprising:

a propulsor, an adapter having a stem that supports the propulsor, a wear resistant snubber on the stem, and an elastomeric member sandwiched between the wear resistant snubber and the stem, the elastomeric member being configured to bias the wear resistant snubber radially outwardly into engagement with the propulsor.

17. The propulsor assembly according to claim 16, wherein the stem comprises an outer flat and wherein the wear resistant snubber comprises a panel on the outer flat, the panel being configured to abut an inner flat on the propulsor.

18. The propulsor assembly according to claim 17, wherein the elastomeric member is elongated and disposed in a corresponding elongated channel in the outer flat.

19. The propulsor assembly according to claim 18, wherein the stem comprises a plurality of outer flats and wherein the wear resistant snubber comprises a plurality of panels on the plurality of outer flats, wherein the elastomeric member is one of a plurality of elastomeric members sandwiched between the plurality of panels and plurality of outer flats, and wherein the wear resistant snubber comprises a monolithic annular member wrapped around the stem.

20. A propulsor assembly comprising:

a propulsor shaft, a propulsor, and an adapter having a stem that supports the propulsor, the adapter comprising a through-bore having an inner radius with a plurality of splines and a beveled inner abutment surface, wherein the propulsor shaft comprises a plurality of splines engaged with a plurality of splines on the inner radius of the adapter, and wherein the propulsor shaft comprises a beveled outer abutment surface, and wherein the beveled inner abutment surface and beveled outer abutment surface are engaged so as to prevent axial inward movement of the adapter on the propulsor shaft.

* * * * *